US007821468B2

(12) United States Patent
Aoyama et al.

(10) Patent No.: US 7,821,468 B2
(45) Date of Patent: Oct. 26, 2010

(54) CHIP ANTENNA, AN ANTENNA DEVICE, AND A COMMUNICATION EQUIPMENT

(75) Inventors: Hiroyuki Aoyama, Kumagaya (JP); Masayuki Gonda, Kumagaya (JP); Sigeo Fujii, Kumagaya (JP); Shuuichi Takano, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 873 days.

(21) Appl. No.: 11/690,231

(22) Filed: Mar. 23, 2007

(65) Prior Publication Data

US 2007/0222689 A1 Sep. 27, 2007

(30) Foreign Application Priority Data

Mar. 23, 2006 (JP) ..... 2006-081063
Apr. 24, 2006 (JP) ..... 2006-118661
Jun. 21, 2006 (JP) ..... 2006-171428

(51) Int. Cl.
*H01Q 1/00* (2006.01)
*H01Q 1/38* (2006.01)

(52) U.S. Cl. ..... 343/787; 343/702; 343/700 MS; 343/872

(58) Field of Classification Search ..... None
See application file for complete search history.

(56) References Cited

U.S. PATENT DOCUMENTS 5,668,557 A * 9/1997 Kawahata ..... 343/700 MS
5,854,606 A * 12/1998 Kawahata et al. ..... 343/702
5,936,593 A * 8/1999 Mandai et al. ..... 343/895
6,028,554 A * 2/2000 Mandai et al. ..... 343/700 MS
6,556,172 B2 * 4/2003 Noro ..... 343/715
6,623,879 B2 * 9/2003 Okano et al. ..... 428/701
6,660,179 B2 * 12/2003 Umeda et al. ..... 252/62.63
2002/0008673 A1 * 1/2002 Shiroki et al. ..... 343/895
2002/0036596 A1 3/2002 Noro
2008/0316111 A1 * 12/2008 Aoyama et al. ..... 343/700 MS

FOREIGN PATENT DOCUMENTS

| | | |
|---|---|---|
| EP | 0 762 537 A2 | 3/1997 |
| EP | 0 812 030 A1 | 12/1997 |
| EP | 1 270 168 A2 | 1/2003 |
| EP | 1 505 689 A1 | 2/2005 |
| JP | 49-40046 | 4/1974 |
| JP | 56-64502 | 6/1981 |
| JP | 3-44203 | 2/1991 |
| JP | 10-145123 | 5/1998 |
| JP | 2003-002656 | 1/2003 |
| JP | 2003-243218 | 8/2003 |
| JP | 2005-175757 | 6/2005 |

* cited by examiner

*Primary Examiner*—Trinh V Dinh
(74) *Attorney, Agent, or Firm*—Paul F. Neils, Esq.; Akerman Senterfitt

(57) ABSTRACT

The linear conductor 2 penetrates the magnetic base 1 along with the longitudinal direction of the magnetic base 1. The linear conductor 2 has a straight shape. The straight shape conductor 2 is installed so that it is surrounded by outside planes of the magnetic base 1, such as the side of a rectangular parallelepiped or a cylindrical peripheral face, and it penetrates both end sides of the magnetic base 1 in the longitudinal direction.

14 Claims, 29 Drawing Sheets

Table 1

| No. | CuO (wt.%) | ZnO (wt.%) | volume resistivity $\times 10^5$ ($\Omega \cdot m$) | density $\times 10^3$ ($kg/m^3$) | initial permeability $\mu_i$ (1GHz) | loss factor tan $\delta$ (1GHz) |
|---|---|---|---|---|---|---|
| 1 | 0 | 0 | 35.6 | 4.52 | 2.1 | 0.01 |
| 2 | 0.2 | 0 | 31.9 | 5.12 | 2.1 | 0.02 |
| 3 | 0.4 | 0 | 23.3 | 4.82 | 2.2 | 0.02 |
| 4 | 0.6 | 0 | 25.9 | 4.84 | 2.8 | 0.03 |
| 5 | 1.0 | 0 | 2.3 | 4.91 | 2.7 | 0.03 |
| 6 | 1.5 | 0 | 1.1 | 4.92 | 3.1 | 0.04 |
| 7 | 2.0 | 0 | 0.7 | 5.05 | 3.4 | 0.06 |
| 8 | 0 | 0.2 | 41.3 | 5.11 | 2.1 | 0.02 |
| 9 | 0 | 0.4 | 35.1 | 5.09 | 2.2 | 0.02 |
| 10 | 0 | 0.6 | 35.7 | 5.13 | 2.3 | 0.02 |
| 11 | 0 | 1.0 | 2.8 | 5.05 | 2.5 | 0.05 |
| 12 | 0 | 1.5 | 0.6 | 5.03 | 2.8 | 0.06 |
| 13 | 0 | 0 | 0.1 | 4.45 | 7.5 | 0.90 |

FIG. 25

Table 2

| No. | initial permeability $\mu_i$ (180MHz) | loss factor tan δ (180MHz) | initial permeability $\mu_i$ (470MHz) | loss factor tan δ (470MHz) | initial permeability $\mu_i$ (770MHz) | loss factor tan δ (770MHz) |
|---|---|---|---|---|---|---|
| 1 | 2.0 | 0.01 | 2.0 | 0.01 | 2.0 | 0.02 |
| 2 | 2.0 | 0.01 | 2.0 | 0.01 | 2.0 | 0.02 |
| 3 | 2.1 | 0.01 | 2.1 | 0.01 | 2.1 | 0.02 |
| 4 | 2.4 | 0.02 | 2.4 | 0.02 | 2.5 | 0.03 |
| 5 | 2.6 | 0.02 | 2.6 | 0.02 | 2.6 | 0.03 |
| 6 | 3.0 | 0.02 | 3.0 | 0.02 | 3.0 | 0.05 |
| 7 | 3.2 | 0.03 | 3.2 | 0.03 | 3.3 | 0.05 |
| 8 | 2.1 | 0.01 | 2.1 | 0.02 | 2.1 | 0.02 |
| 9 | 2.2 | 0.01 | 2.2 | 0.02 | 2.3 | 0.02 |
| 10 | 2.3 | 0.01 | 2.3 | 0.02 | 2.3 | 0.03 |
| 11 | 2.8 | 0.02 | 2.8 | 0.04 | 2.8 | 0.07 |
| 12 | 3.3 | 0.03 | 3.3 | 0.05 | 3.3 | 0.05 |
| 13 | 14.9 | 0.04 | 14.8 | 0.17 | 14.8 | 0.86 |

FIG. 26

Table 3

| Antenna No. | | No of turns | Antenna Characteristics(470～770MHz) | | | | |
|---|---|---|---|---|---|---|---|
| | | | resonance frequency (MHz) | average gain bandwidth frequency range (MHz) | | maximum gain bandwidth frequency range (MHz) | |
| | | | | >-7dBi | >-5dBi | >-7dBi | >-5dBi |
| 1 | Example | — | 590 | >268 [470～738] | >206 [470～676] | >296 [470～766] | >256 [470～726] |
| 2 | Comp. Example | 15.75 | 650 | 100 [588～688] | 51 [617～668] | 126 [575～701] | 92 [595～687] |

FIG. 27

Table 4

| Antenna No. | matching circuit | Antenna Characteristics(470～770MHz) | | | | | |
|---|---|---|---|---|---|---|---|
| | | average gain (ZX-plane) | | | average gain(all plane average) | | |
| | | resonance frequency (MHz) | average gain bandwidth frequency range (MHz) | | resonance frequency (MHz) | maximum gain bandwidth frequency range (MHz) | |
| | | | >-7dBi | >-5dBi | | >-7dBi | -5dBi |
| 3 | high-pass | 625 | >255 [515～770] | >237 [533～770] | 633 | >239 [531～770] | >222 [548～770] |
| | low-pass | 487 | >272 [470～742] | >240 [470～710] | 490 | >242 [470～712] | >185 [470～655] |
| 4 | none | 592 | >232 [470～702] | 213 [470～683] | 590 | 209 [477～686] | 160 [500～660] |

FIG. 28

Table 5

| matching circuit | average gain(470～770MHz) | | |
|---|---|---|---|
| | resonance frequency (MHz) | average gain bandwidth frequency range (MHz) | |
| | | >-7dBi | >-5dBi |
| high-pass | 635 | 225 [545～760] | 207 [567～770] |
| low-pass | 590 | >221 [470～691] | >195 [470～665] |

FIG. 29

CHIP ANTENNA, AN ANTENNA DEVICE, AND A COMMUNICATION EQUIPMENT

BACKGROUND OF THE INVENTION

1. Field of the Invention

This invention relates to a chip antenna used for electronic equipment with a communication function, such as cellular phone and personal digital assistant equipment, as well as an antenna device and communication equipment using such chip antenna.

2. Description of the Related Art

The frequency range in communication equipment, such as a cellular phone and wireless LAN, ranges from hundreds of MHz to several GHz. It is required for this frequency range to be wide and for the efficiency in this range to be high. Therefore, the antenna used for this communication equipment also needs to have high gain in this frequency range and to be small and thin. In the ground digital broadcasting started in recent years, the frequency range in the television broadcasting in Japan is 470 MHz-770 MHz, for example. When it corresponds to all the channels, it is required that this antenna can receive such a wide frequency range. As digital broadcasting, 180 MHz-210 MHz band is used in South Korea and 470 MHz-890 MHz band is used in Europe. Therefore, a small antenna which can be carried in communication equipment, such as a personal digital assistant, is desired to be usable in a frequency range of 180 MHz or more. It is especially demanded to be small and also thin.

Conventionally, a chip antenna using dielectric ceramics as a small antenna suitable for mobile communications has been offered (for example, see Japanese Patent No. H10-145123). When setting frequency constant, miniaturization of a chip antenna can be attained by using dielectrics with a higher dielectric constant. In art given in this document, the wavelength is shortened by providing a meander shaped electrode. Moreover, the antenna aiming at miniaturization is also proposed by shortening a wavelength $1/(\in r \cdot \mu r)^{1/2}$ times using the magnetic material with large relative permittivity $\in r$ and large relative magnetic permeability $\mu r$ (for example, see Japanese Patent No. S49-40046).

Moreover, for example with a small liquid crystal television, the whip antenna using the metal stick is generally used as a receiving antenna currently used for television or radio. This system is beginning to be used also for the cellular phone with television function. Furthermore, the electric wire, which is a part of earphones used with a cellular phone, may be used as a receiving antenna of radio or television.

Although the above-mentioned dielectric chip antenna is advantageous for a miniaturization and thinning, there are the following problems to make bandwidth of a frequency range wide. For example, when using a helical-type radiation electrode as an electrode, if the number of turns increases, the capacitance between electric wires will increase and Q value will become high. Therefore, bandwidth becomes narrow and it becomes difficult to apply to uses, such as ground digital broadcasting for which wide bandwidth is required. Also using another type of electrode, there was a problem that bandwidth could not be made wide because of the capacity between electric wires when patterned electrodes, such as a meander shaped electrode, are formed, or when many electrodes are exposed to the inside of a base substance, or the exterior, etc. Even if it is the antenna using a magnetic material indicated in the 2nd documents, a miniaturization or widening of the bandwidth cannot be achieved, unless it suppresses formation of a capacity component in this structure and an inductance component is formed effectively.

Since the above-mentioned whip antenna was large, in order to store it to small apparatus, such as a cellular phone, complicated mechanism is needed. There was a problem of being easy to break when this apparatus falls. With the above-mentioned earphone type antenna, when using radio and television, the reliability of an antenna falls by repeating attachment and detachment. When the electric wire used as an antenna contacts a human body, a gain and sensitivity may deteriorate remarkably.

Therefore, the present invention aims at providing a chip antenna, an antenna device, and communication equipment suitable for making miniaturization and bandwidth of a frequency band wide.

SUMMARY OF THE INVENTION

The present invention is constructed as described below in order to solve the aforementioned problems.

An aspect in accordance with the present invention provides a chip antenna in which a linear conductor penetrates a magnetic base along the longitudinal direction of the magnetic base, the ratio of inner diameter r to outer diameter R, in a section perpendicular to the longitudinal direction of the magnetic base, r/R being 0.1 or more.

Here, when a magnetic base takes rectangular parallelepiped shape, a longitudinal direction of a magnetic base is a direction met a side with the greatest length. When a magnetic base takes cylindrical shape etc., this longitudinal direction is equal to shaft orientations. When a magnetic base takes arc shape, this longitudinal direction is equal to a direction in alignment with that circle. In such a direction, when a linear conductor has penetrated, a capacity component is hard to form. A magnetic body portion can be effectively operated as an inductance component. Therefore, it contributes to broadening of bandwidth of an antenna, and a miniaturization. And by setting the ratio r/R to 0.1 or more, a high average gain is obtained.

Another aspect in accordance with the present invention provides the chip antenna, wherein the ratio r/R is 0.5 or less. Here, when the outside form of a base and the form of a through-hole are quadrangles, an outer diameter and an inner diameter refer to one side of a quadrangle. When the form of an outside and the form of a through-hole are circular, an outer diameter and the diameter of a through-hole correspond to the above-mentioned outer diameter and an inner diameter. Here, the minimum diameter corresponds to an inner diameter.

As for the chip antenna, it is preferred that the straight shape conductor has penetrated the magnetic base. With this composition, since the another conductive portion which faces this conductor, is not formed in a base, especially a capacity component is hard to be formed. Since a magnetic body portion can be effectively operated as an inductance component, it contributes to the broadening of bandwidth of an antenna, and a miniaturization.

Another aspect in accordance with the present invention provides a chip antenna in which a linear conductor penetrates a magnetic base along the longitudinal direction of said magnetic base, the ratio of cross-sectional area s of the conductor to cross-sectional area S of the magnetic base, in a section perpendicular to said longitudinal direction of said magnetic base, s/S being 0.029 or more. According to this composition, antenna internal loss can be suppressed low.

Another aspect in accordance with the present invention provides the chip antenna, wherein the ratio s/S is 0.125 or less. Thereby, it can control resonance frequency deviation.

Another aspect in accordance with the present invention provides a chip antenna in which a linear conductor penetrates a magnetic base along the longitudinal direction of said magnetic base, the bandwidth in which average gain is −7 dBi or higher, being 220 MHz or wider. If the chip antenna of this composition is used, a large frequency range signal is receivable with one chip antenna. For example, the ground digital broadcasting which uses a range of 470-770 MHz is also receivable with two or less chip antennas. The complete average of an average gain means what took the average of the average gain in XY plane, YZ plane, and ZX plane.

Another aspect in accordance with the present invention provides a chip antenna in which a linear conductor penetrates a magnetic base along the longitudinal direction of said magnetic base, the magnetic bases being composed of ceramics of Y type ferrite.

Y type ferrite maintains high magnetic permeability to a high frequency region, and its loss factor is also low. Here, a loss factor means tan δ. Therefore, if the ceramics of Y type ferrite are used, it is advantageous when a chip antenna receivable to a high frequency band is constituted. The magnetic base is composed of Y type ferrite, or the magnetic base contains not only Y type ferrite single phase, but contains other phases, such as Z type and W type.

Another aspect in accordance with the present invention provides the chip antenna, wherein the density of said Y type ferrite is higher than $4.8\times10^3$ kg/m$^3$. As for the density of said Y type ferrite ceramics, it is preferred that it is more than $4.8\times10^3$ kg/m$^3$. According to this composition, it is suitable for the portable device with which big impacts, such as fall, are added easily.

Another aspect in accordance with the present invention provides the chip antenna, wherein initial permeability at 1 GHz of said Y type ferrite is set to 2 or more, wherein loss factor is set to 0.05 or less. By using this ferrite, the antenna characteristics in a high frequency range is improves.

Another aspect in accordance with the present invention provides the chip antenna, wherein the magnetic base is set to 30 mm or less in length, wherein the magnetic base is set to 10 mm or less in width, wherein said magnetic base is set to 5 mm or less in height. The chip antenna concerning this invention using a magnetic base is advantageous to miniaturization, and small dimensions can be maintained even when using it in a hundreds of MHz frequency range. It becomes a suitable chip antenna for the portable devices (cellular phones etc.) in which mounting space was restricted, about the length of a magnetic base by 30 mm or less and width being 10 mm or less, and height being 5 mm or less.

Another aspect in accordance with the present invention provides the chip antenna, wherein the magnetic base takes rectangular parallelepiped shape, wherein beveling is formed in the portion of the corner located in the direction perpendicular to said longitudinal direction of said rectangular parallelepiped shape. Taking rectangular parallelepiped shape advantageous to stable mounting, by forming beveling in the portion of the corner located in the direction perpendicular to the longitudinal direction of this rectangular parallelepiped shape, i.e., the corner prolonged in the longitudinal direction, chipping can be suppressed and the chip antenna with high quality can be offered.

Another aspect in accordance with the present invention provides the chip antenna, wherein the chip antenna is accommodated in a case. According to this composition, it becomes tough against external force. When this antenna is used, it is protected against collision with other members, therefore reliability becomes high.

As for said case, it is preferred that the conductor member is provided on the lateral surface. This conductor member and the conductor part in the substrate which mounts a chip antenna can be joined with solder etc., and a chip antenna can be fixed to a substrate etc. with a case. As for this conductor member, it is more preferred to be connected electrically with the end of said chip antenna at least. Thereby, it can serve both as the electrical connection between a substrate etc. and a chip antenna, and mechanical junction.

Another aspect in accordance with the present invention provides an antenna device using the chip antenna, one end of the conductor constituting an open end, another end being connected to a feeder circuit. Since the chip antenna with low capacity is used, an antenna device with wide bandwidth is obtained.

Another aspect in accordance with the present invention provides the antenna device, wherein the antenna device has a substrate which mounts said chip antenna, wherein on the substrate, an ground electrode and a fixing electrode are formed set apart from said ground electrode, wherein one end of said conductor is connected to said fixing electrode. With this composition, a capacity component can be formed between an ground electrode and a fixing electrode, and capacity can be adjusted. Thereby, compared with the method of adjusting the capacity component of the chip antenna itself, a capacity component can be adjusted simply. In said antenna device, it is preferred that the bandwidth with an average gain over all planes, is −7 dBi or higher, is 220 MHz or wider. The antenna device with this large bandwidth is suitable for the purpose using wide frequency band, for example, ground digital broadcasting. That is, in a 470-770 MHz frequency range, if it has this bandwidth, the usage band of ground digital broadcasting is receivable with two or less antenna devices.

Another aspect in accordance with the present invention provides the antenna device, wherein the antenna device has a matching circuit between said chip antenna and said feeder circuit, wherein said matching circuit adjusts resonance frequency of said antenna device, wherein said matching circuit is switched and changed. According to this composition, the antenna device which receives the wide frequency range, which one chip antenna could not receive previously, is realized. And wide bandwidth can be received, without increasing the number of chip antennas more than needed.

It is preferred that the average gain over all faces in 470-770 MHz frequency range is −7 dBi or higher. It becomes possible to apply an antenna device to the use which uses a 470-770 MHz band like the ground digital broadcasting in Japan, without increasing the number of chip antennas by giving the function of regulating resonance frequency to the impedance matching circuit.

Another aspect in accordance with the present invention provides an antenna device which consists of a chip antenna provided with a magnetic base and a linear conductor which penetrates said magnetic base along the longitudinal direction of said magnetic base, and a substrate on which said chip antenna is mounted, both ends of said conductor protrude from said magnetic base, the both ends are bended outside said magnetic base, the both ends are connected to electrodes formed in said substrate.

Since it is not necessary to form an electrode in a base separately or to take a measure separately to the substrate side to connect according to this composition, a connection process will become simple.

Another aspect in accordance with the present invention provides an antenna device which consists of a chip antenna provided with a magnetic base and a linear conductor which penetrates said magnetic base along the longitudinal direction of said magnetic base, and a substrate on which said chip antenna is mounted, both ends of said conductor protrude from said magnetic base, a notch or an opening is formed in said substrate, said magnetic base is inserted in said notch or said opening, said both ends are connected to the electrodes formed on said substrate.

With this composition, since a part of the base goes into the notch section or opening of a substrate, the height of the base after mounting can be made low, it contributes to thinning of an antenna device. Since it can connect with the electrode on a substrate, without making a conductor bended, a process is simplified.

Another aspect in accordance with the present invention provides, said antenna device for ground digital broadcasting. Since miniaturization and broadening of bandwidth are attained, the aforementioned antenna device concerning this invention is suitable for the ground digital broadcasting using a wide frequency range like a 470-770 MHz band, for example. Another aspect in accordance with the present invention provides, a communication equipment using said antenna device.

Since said antenna device functions in a wide frequency range, it can also use the communication equipment using it in a wide frequency range. If communication equipment which carries said antenna device especially, such as a personal digital assistant for ground digital broadcasting, a cellular phone, digital radio, is constituted, it will contribute to improvement in the portability of this apparatus, and reliability.

The composition of said chip antenna, said antenna device, and said communication equipment can also be combined suitably. According to this invention, a chip antenna suitable for miniaturization and widening of bandwidth can be offered. When Y type ferrite with high magnetic permeability and a low loss factor, is especially used as a magnetic base of a chip antenna, the chip antenna with high gain in high frequency range, can be offered. The antenna device and communication equipment which can receive a wide frequency range are realizable by using the chip antenna concerning this invention.

BRIEF DESCRIPTION OF THE DRAWINGS

FIG. 25 contains Table 1 showing measured volume resistivity, density, and initial magnetic permeability and loss factor in the frequency of 1 GHz of the materials according to Example 1.

FIG. 26 contains Table 2 showing measured initial magnetic permeability and loss factor at the frequency of 180 MHz, 470 MHz, and 770 MHz of the materials according to Example 1.

FIG. 27 contains Table 3 showing the case of the bandwidth of −7 dBi or more and the case of the bandwidth of −5 dBi or more.

FIG. 28 contains Table 4 showing the result of a measurement in Example 2.

FIG. 29 contains Table 5 showing evaluation result of the average gain averaged in all plane in Example 3.

DETAILED DESCRIPTION OF THE INVENTION

Although the present invention is explained hereafter with concrete embodiments, the present invention is not limited to these embodiments. The same numerals designate the same member.

Structure of a Chip Antenna

Figure 1B:
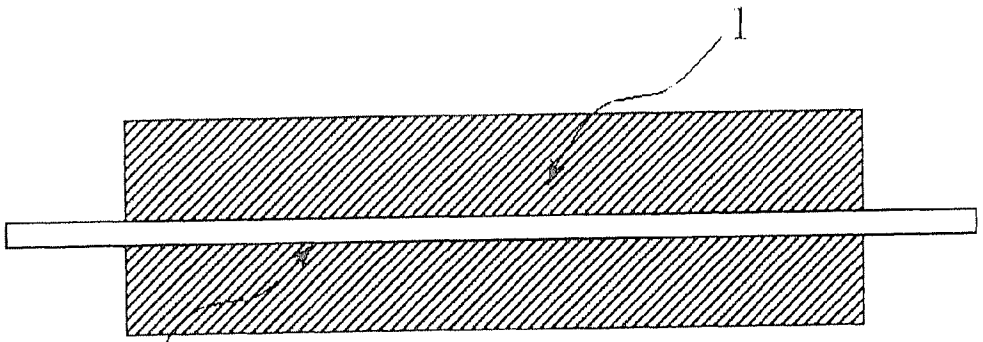
FIGS. 1(*a*)-1(*c*) show an embodiment of the chip antenna of the invention.
Figure 1C:
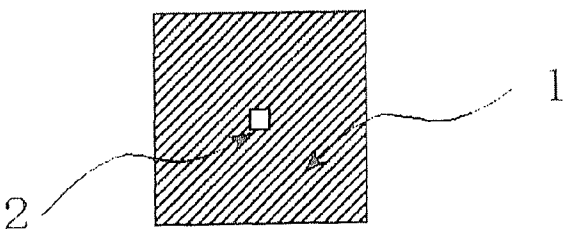
Figure 1:
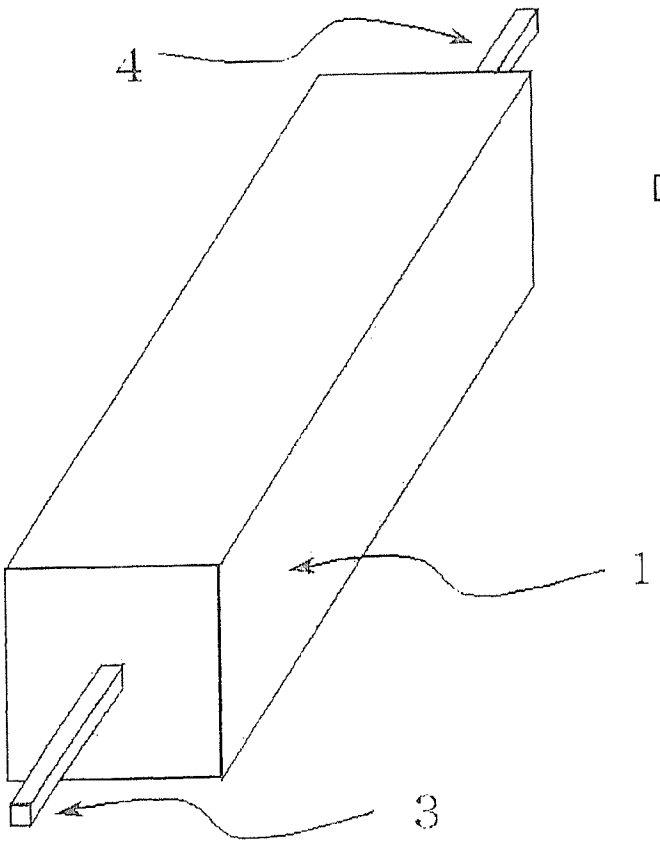

An embodiment of the chip antenna concerning the present invention is shown in FIG. 1. The chip antenna of FIG. 1 is a magnetic body chip antenna which uses magnetic ceramics as a base. The chip antenna can be mounted on a substrate and can be used.

FIG. 1(*a*) is a perspective view and FIG. 1(*b*) is the sectional view which contains a conductor along the longitudinal direction. FIG. 1(*c*) is a sectional view in a direction perpendicular to the longitudinal direction. A linear conductor 2 penetrates the magnetic base 1 along the longitudinal direction of the magnetic base 1. In FIG. 1, the linear conductor 2 has a straight shape. The straight shape conductor 2 is installed so that it is surrounded by outside planes of the magnetic base 1, such as the side of a rectangular parallelepiped or a cylindrical peripheral face, and it penetrates both end sides of the magnetic base 1 in the longitudinal direction. With the composition of FIG. 1, the both ends of the conductor 2, i.e., one end 3 and the other end 4 of a conductor, protrude from magnetic base 1. The one end 3 of the above-mentioned conductor constitutes an open end, and the other end 4 is connected to control circuits (not shown), such as an electric supply circuit, and an antenna device is constituted. Since the straight shape conductor 2 only exists in the core of the magnetic base 1 as a conductor part, it becomes a structure ideal for reduction of a capacity component. It is the structure in which one straight shape conductor 2 which functions as a radiation conductor has penetrated, and since this conductor does not substantially have a portion which faces each other inside a base, it is effective in especially reduction of a capacity component. The number of the conductor which penetrates the magnetic base 1 is preferred to be one. However, it is also possible to have another penetrating conductor besides the one penetrating conductor at certain interval if the influence of a capacity component is small.

Figure 8:
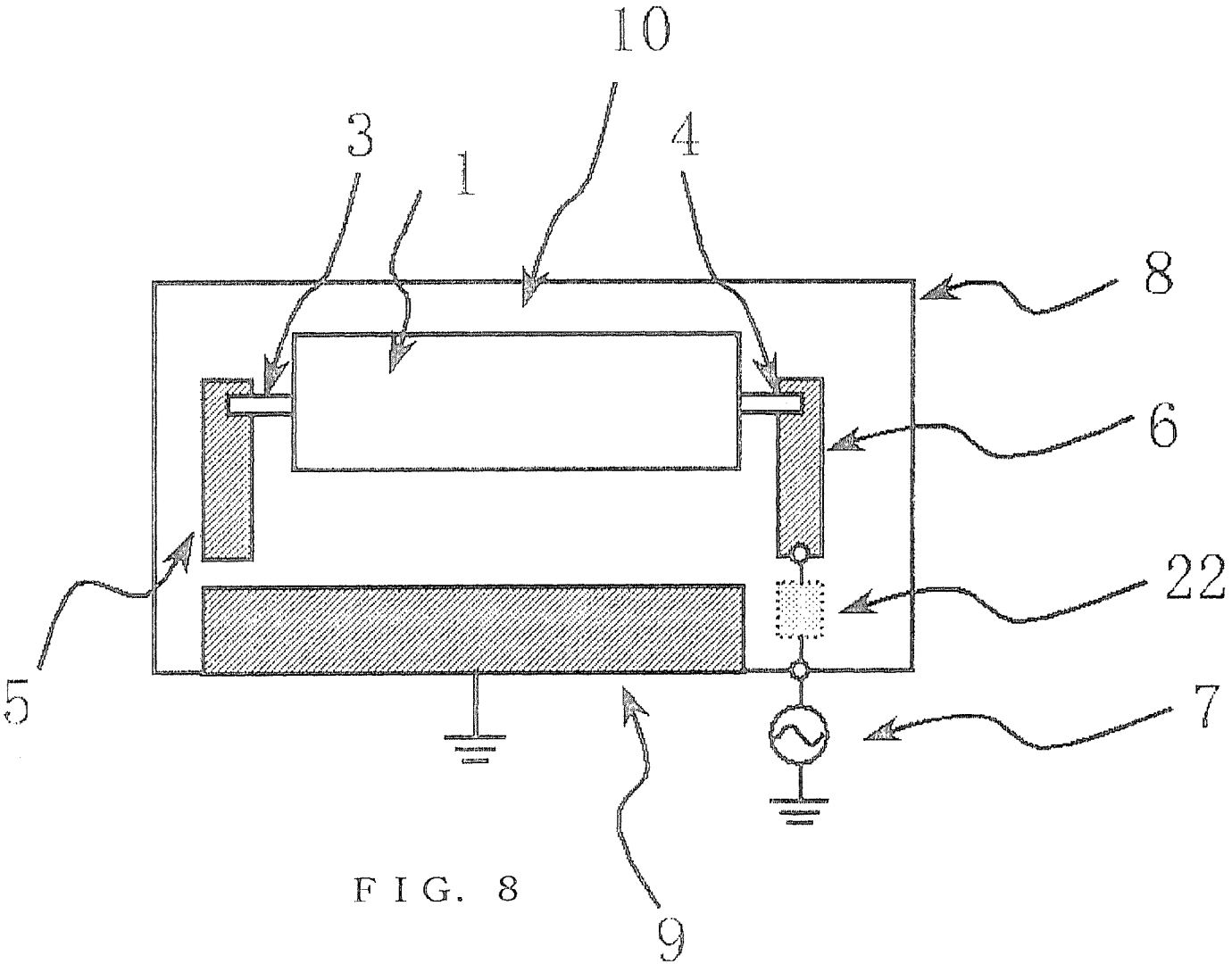
FIG. 8 shows another embodiment of the antenna device of the invention.
Figure 14:
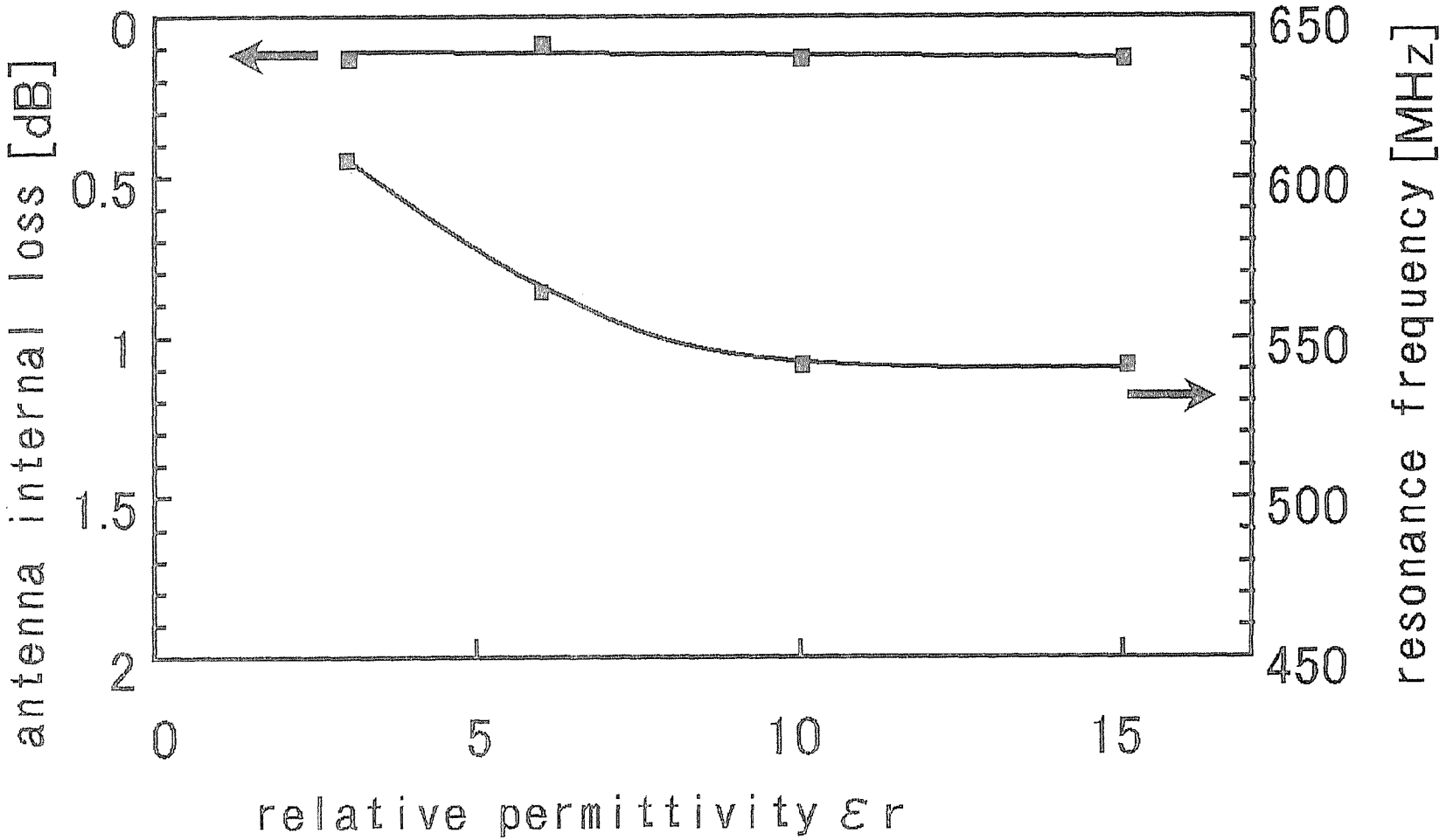
FIG. 14 shows the relation between the relative permittivity and the antenna internal loss.

FIG. 14 shows the result of evaluated antenna internal loss and the relative permittivity dependability of resonance frequency using the antenna device (will be discussed later in detail) of the composition as shown in FIG. 8 using this chip antenna. Here, the antenna internal loss is the value which converts the sum of the material loss in a base, and conductor loss as antenna gain. As for the dimension of the magnetic base 1, 30 mm in length, 3 mm in width, 3 mm in height, and initial magnetic permeability set 3 and a loss factor to 0.05. The conductor 2 which penetrates the center of the magnetic base 1 is made of copper (the center of magnetic base 1 is made of copper) with the section area of 0.5 mm squares. The interval of the magnetic base 1 and the ground electrode 9 is 11 mm.

Figure 15:
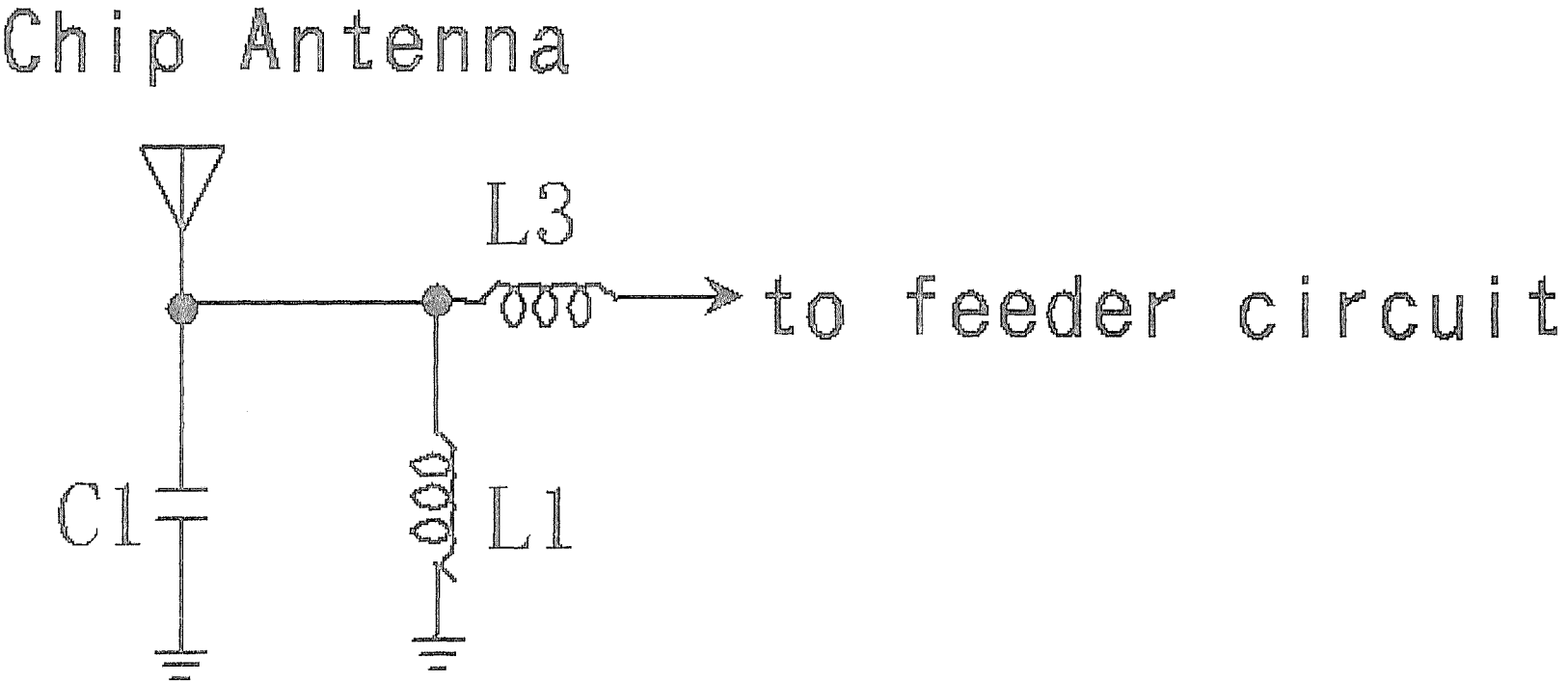
FIG. 15 shows an example of a matching circuit.

FIG. 15 shows the matching circuit. The capacitor C1 is set to 0.5 pF, inductor L1 is set to 56 nH, and inductor L3 is set to 15 nH. As shown in FIG. 14, the internal loss of an antenna is hardly changing, even if the relative permittivity changes. Since this structure cannot form a capacity component easily, the increase in the internal loss of an antenna is controlled even if the relative permittivity becomes large. In order to make the internal loss low, a low relative permittivity is preferred, but with this structure, the internal loss of an antenna cannot be easily influenced by the relative permittivity. Therefore, the internal loss is insensible to the relative permittivity. Therefore, as shown, for example in FIG. 14, in order to suppress the variation in resonance frequency, material with large relative permittivity can also be used. In this case, as for relative permittivity, 8 or more is preferred, and 10 or more is more preferable.

Since the conductor 2 penetrates the magnetic base 1 when the length of the conductor in a magnetic base is the same, the miniaturization of the whole chip antenna can be attained, compared with the case where the conductor does not penetrate. Since the conductor 2 penetrates the magnetic base 1 at both ends of the conductor 2, other circuit elements and electrical connection with an electrode are possible, and a design flexibility is high. It is preferred for a straight shape conductor to penetrate the base, keeping the distance constant from planes of the base which surrounds outside the conductor and in which the conductor is located, such as the side plane of a rectangular parallelepiped, and a cylindrical peripheral face. With the composition shown in FIG. 1, the conductor 2 penetrates almost at the center of the magnetic base in the longitudinal direction of the magnetic base 1. Namely, in a section perpendicular to the longitudinal direction of magnetic base 1, the conductor 2 is mostly located at the center (see FIG. 1(*c*)).

Figure 12A:
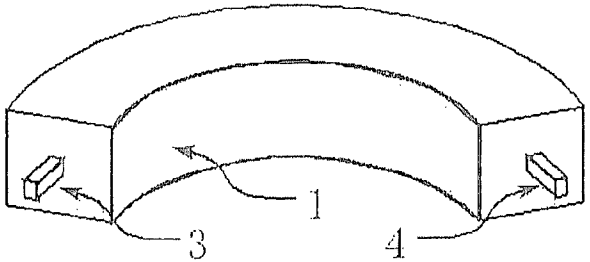
FIGS. 12(*a*)-12(*c*) show another embodiments of the chip antenna of the invention.
Figure 12B:
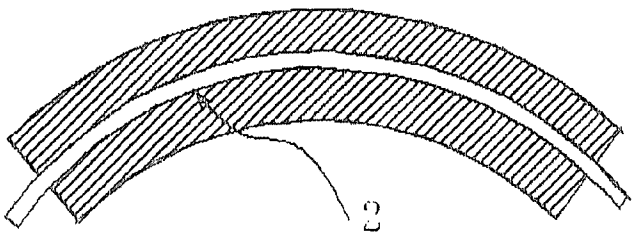
Figure 12C:
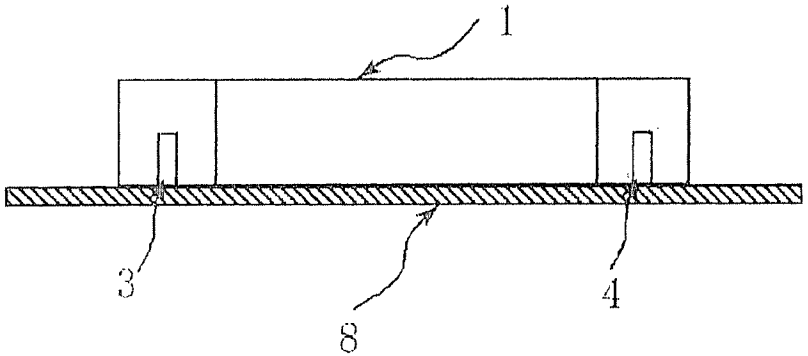

If the linear conductor penetrates the magnetic base along the longitudinal direction of a magnetic base as composition of a chip antenna shown in FIG. 12, not only a rectangular parallelepiped shape, but a circular (arch) shape can be used. FIG. 12(*a*) is a perspective view and FIG. 12(*b*) is a sectional view containing the portion of a conductor. FIG. 12(*c*) is the front view seen from the plane direction of a substrate in which the composition as shown on FIG. 12(*a*) is mounted. In the composition in which the linear conductor meets the longitudinal direction of the magnetic base, the conductor constitutes neither a coil nor a meander shaped electrode in the base. It is preferred not to have a flection to a longitudinal direction. With the composition of FIG. 12, the linear conductor 2 penetrates the arc base 1 along a circle. That is, the linear conductor is installed along planes of the outside of a base in which it is located so that a conductor may be surrounded, such as the side of a rectangular parallelepiped, and a cylindrical peripheral face, and penetrates between both end faces in base longitudinal directions. In this case, it is preferred to have penetrated the base, keeping the distance constant from the plane of the base outside in which it is located so that a conductor may be surrounded. A conductor is located at the center of the section of the base of arc shape in FIG. 12.

With the composition of FIG. 12, the both ends of the conductor, i.e., one end 3 and the other end 4 of the conductor, protrude from the magnetic base 1. If the portion except the magnetic base and the conductor being with arc shape, is made to be the same as that of the case of FIG. 1, an antenna device and communication equipment are constituted similarly. In FIG. 12(*c*), the one end 3 and the other end 4 of the conductor are bended in the portion set away from the magnetic base 1, and are being fixed to the fixing electrode and feed electrode (not shown) on the substrate 8. By making a conductor bended in the portion set away the magnetic base, the damage in the conductor and the magnetic base when the conductor is bended, is controlled. A capacity component is also reduced.

In order to make bandwidth wide, it is necessary to lower the Q value of an antenna. Q value is expressed with $(C/L)^{1/2}$, here inductance is set to L, capacity is set to C. Therefore, when raising L, it is necessary to lower C. When dielectrics are used as a base, in order to raise inductance L, it is necessary to increase the number of turns of a conductor. However, since the increase in the number of turns causes the increase in the capacity between lines, it cannot lower the Q value of an antenna effectively. On the other hand, in this invention, since a magnetic material is used as a base, it cannot be based on the increase in the number of turns, but inductance L can be raised by raising magnetic permeability. Therefore, the increase in the line capacity by the increase in the number of turns can be avoided, a Q value can be lowered, and bandwidth can be made wide. By this invention, in order that a straight shape conductor effective for reduction of a capacity component may penetrate a magnetic base as mentioned above, an effect especially remarkable in making bandwidth wide is demonstrated. In this case, since a magnetic path is formed in a magnetic base so that the conductor 2 may be gone around, it constitutes a closed magnetic circuit. Inductance component L obtained with this composition depends on the length and the cross-sectional area of a portion in magnetic base 2, that cover on conductor 2. Therefore, when a straight shape conductor does not penetrate magnetic base 1, the portion which does not contribute to inductance component L will increase, and a chip antenna will be enlarged superfluously. On the other hand, when the conductor 2 penetrates the magnetic base 1, L component is kept efficient and the miniaturization of a chip antenna can be attained.

End Structure of a Conductor

Connection of the conductor in the exterior of magnetic base 1 is made by forming a printed electrode in the magnetic base 1. It is possible to perform fixation by soldering with the print electrode concerned. In order to simplify a manufacturing process and to suppress the increase in capacity, it is preferred to perform soldering etc. using the protruded end in conductor 2. In addition, when managing this wiring in the exterior of a magnetic base substance using a printed electrode, it is desirable to make that area and an opposing portion as small as possible in this printed electrode.

When the both ends of the conductor 2 protrude like the composition of FIG. 1, solder fixation of the chip antenna 10 can be performed at two places, one end (henceforth the 1st end) and the other end (henceforth the 2nd end) of the conductor 2.

Therefore, stable mounting is attained. It is not necessary to provide an electrode on a base separately for mounting, and simplification of the process of constituting an antenna device is attained with this composition. The protruding end may not necessarily be on a straight line, and may be bended like the embodiment of FIG. 2. In the composition shown in FIG. 2, the portion of the conductor 2 protruding from both sides of the magnetic base 1 is bended in the portion set away the magnetic base 1 so that it may be easy to mount in a substrate.

The tip is located in parallel with the bottom (almost same surface concretely) which is an end surface of the magnetic base 1. It may be bended at about 90 degrees, and the conductor part protruding on both sides of magnetic base 1 may be inserted and soldered to the through hole made in the substrate. The electrode for fixing by soldering other than the conductor etc. for firmer fixation, may be provided in the magnetic base of a chip antenna. It is also possible to constitute the antenna device with which the chip antenna was fixed using this electrode.

In any case, when managing a conductor at the protruding end, since it is not necessary to form an electrode on the surface of the magnetic base substance 1, the increase in capacity can be suppressed. In the composition of FIG. 1 whose protruding portions take a linear shape, since the conductor 2 taking a linear shape does not have a portion which faces each other in the core and the surface of a magnetic base, it is effective especially for reduction of a capacity component.

Material of a Conductor

Although the material of a conductor is not limited particularly, such as Cu, Ag, Ni, Pt, Au, Al, besides 42 alloys, covar, phosphor bronze, brass, and the Corson copper alloy, can be used for it, for example. Among these, the conductor material with low hardness, such as Cu, is suitable when bending at both ends. Conductor materials with high hardness, such as 42 alloys, covar, phosphor bronze, and the Corson copper alloy, are suitable, when supporting a magnetic base firmly, or when it is not bended but uses both ends with linear shape. Insulating cover layers, such as polyurethane and enamel, may be provided on a conductor. For example, although it is also possible to secure an insulation by using a magnetic base with that of the high volume resistivity more than $1\times10^5\Omega\cdot m$, high insulation is especially acquired by providing an insulating cover layer. In this case, as for the thickness of an insulating cover layer, 25 micrometers or less are preferred. If this becomes thick too much, the interval of a magnetic base and a conductor will become large, and an inductance component will decrease.

Shape and Dimension of a Magnetic Base

Although the shape of a magnetic base is not limited particularly, it can be made into rectangular parallelepiped shape, cylindrical shape, etc. When realizing stable mounting, the shape of a rectangular parallelepiped is preferred. In the case of rectangular parallelepiped shape, it is preferred to form beveling in the portion of the corner located in the direction perpendicular to a longitudinal direction. Although rectangular parallelepiped shape is advantageous to stable mounting, at the portion of the corner, it is easy to generate chipping. On the other hand, magnetic flux becomes difficult to leak by forming beveling, and also this chipping etc. can be prevented. Four corners located in the direction perpendicular to the longitudinal direction of rectangular parallelepiped shape exist, as corners prolonged in the longitudinal direction. That effect will be demonstrated if beveling is formed in at least one of the four corners. It is preferred that beveling is formed at four corners from a viewpoint of reliability.

Beveling may be formed also in the corner of the end of the longitudinal direction of a magnetic base. As the method of beveling, it may be the method of processing an corner into straight shape, and the method of giving a radius of curvature, namely, processing an corner into arc shape may be used. Beveling can be formed by machining of grinding etc., and barrel polishing. It can be also formed with fabrication by the die which provided the beveling portion. However, in order to be prevention of a defect occurring in a magnetic base, and simplification of a process, it is preferred to form a beveling portion by the fabrication by the die which provided the beveling portion, especially extrusion molding. In this case, since a beveling portion comprises sintered surface, it is hard to generate a defect. As for width d of beveling (length lost by the beveling portion in the side of a magnetic base), in order to demonstrate the effect, it is preferred that it is 0.2 mm or more.

On the other hand, stable mounting becomes difficult even if it takes rectangular parallelepiped shape, when beveling becomes large. Therefore, as for d, it is preferred that it is 1 mm or less (⅓ or less of the width or height of a magnetic base). If the length, width, and height in a magnetic base become large, resonance frequency will fall. Therefore, it is preferred that the length shall be 30 mm or less. It is preferred that the width shall be 10 mm or less. It is preferred that the height shall be 5 mm or less. If the dimension of a base exceeds said range, it will enlarge as a surface mount type chip antenna.

For example, in order to use it for 470-770 MHz which is a frequency range used for the ground digital broadcasting in Japan, when carrying out resonance frequency near 550 MHz, it is preferred that the length of a magnetic base shall be 25-30 mm and width shall be 3-5 mm, and height shall be 3-5 mm. As shown in FIG. 12, the base which takes shape with curved surfaces, such as arch shape, may be sufficient. In this case, not only design nature improves, but the shock resistance over the impact impressed to the base of an antenna improves. This is because an antenna is carried in the end of a terminal, so the tolerance over external force generally becomes high by turning the curved surface of the arch-shaped outside in the direction of an end.

The following effects are also demonstrated as other effects of an arch form antenna. It will become difficult to flow a part of electromagnetic waves emitted from an antenna into a metal part, if the interval of an antenna and surrounding metal parts (a loudspeaker, a receiver, a liquid crystal display element, etc.) is enlarged. Therefore, the gain and sensitivity of an antenna improve and the electro magnetic radiation from a metal part is controlled. Therefore, the directive disorder in an antenna can also be reduced.

Relation of the Section Shape of a Conductor and a Magnetic Base

Although the section shape of a conductor is not limited in particular, either, this section shape can be made into circular shape, rectangular shape, and square shape, for example. It can be made into wire shape and the shape of a tape type. If the section shape of a conductor and the section shape of a magnetic base are similar, the thickness of the magnetic base which surround a conductor will become almost fixing. In this case, since a highly homogeneous magnetic path is formed, it is desirable. Here, a section perpendicular to the longitudinal direction of the magnetic base is meant as a section.

For example, when the straight shape conductor has penetrated to the longitudinal direction of the magnetic base taking rectangular parallelepiped shape or cylindrical shape, in a section perpendicular to this longitudinal direction, it becomes a section where a magnetic base encloses a conductor. When a magnetic base takes curved shape like arc shape (arch shape), it is a section in a direction perpendicular to the direction of a circumference of this circle, i.e., the direction of the diameter. It becomes a section where a magnetic base encloses a conductor also in this case. The cross-sectional area of a magnetic base is cross-sectional area except the portion of the through-hole by which the conductor is arranged.

Figure 24:
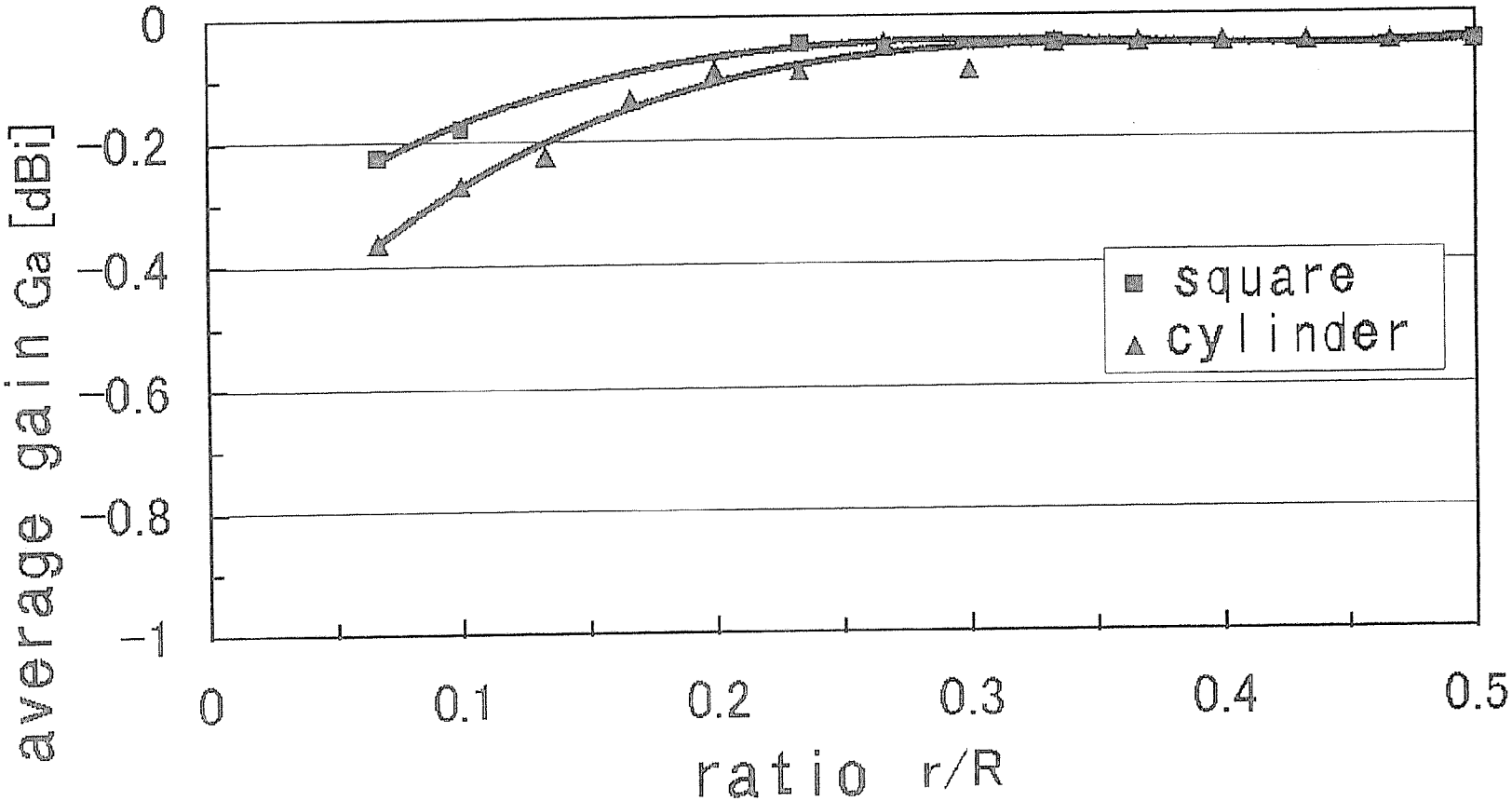
FIG. 24 shows the relation between the ratio r/R of the outer diameter to the inside diameter and the average gain in a magnetic base.

The outer diameter of the magnetic base in the section of a magnetic base is set to R here, and an inside diameter is set to r. The r/R dependence of the average gain of a chip antenna is shown in FIG. 24. In FIG. 24, the case where a conductor takes square pillar shape (the section shape of a through-hole is a quadrangle), and the case where a conductor takes cylindrical shape (the section shape of a through-hole is circular) are shown.

When an outside and through-hole shape are quadrangles, an outer diameter and an inside diameter refer to one side of a quadrangle. When an outside and through-hole shape are circular, an outer diameter and the diameter of a through-hole are equivalent to the outer diameter and an inside diameter. As for the dimension of magnetic base 1, 30 mm in length, 3 mm in width, 3 mm in height, and initial magnetic permeability setting 3 and a loss factor (tan δ) to 0.02. If r/R becomes large, an average gain will be an almost constant value. Setting r/R to 0.1 or more, average gain can be made into the range of less than 0.2 dBi from the constant value mentioned above. More preferably, setting r/R to 0.15 or more, average gain can be made into the range of less than 0.1 dBi from the constant value mentioned above. r/R is 0.2 or more preferably. When a conductor is a quadrangle, it is preferred to make r/R or less to 0.5. If r/R becomes large too much, the portion of a magnetic base will become thin relatively, and the mechanical strength of a chip antenna will fall. Since the volume of a magnetic base becomes small, it becomes difficult to fully maintain the performance of a magnetic body chip antenna.

The Ratio of the Cross-Sectional Area s/S

Figure 16:
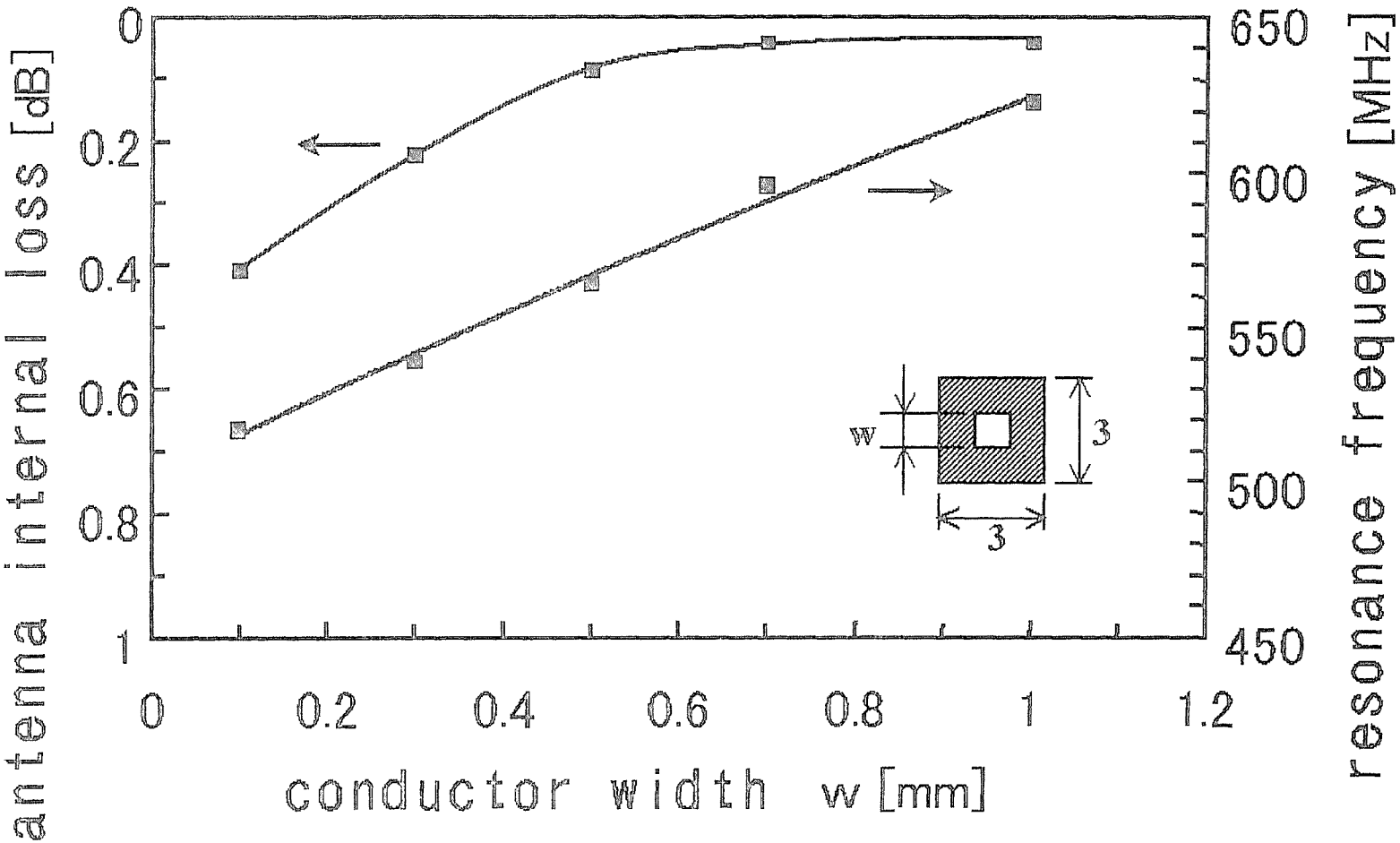
FIG. 16 shows the conductor width dependence of the relation between the antenna internal loss and the resonance frequency.

The example of the result of having measured the s/S dependability of internal loss is shown in FIG. 16. Except having changed the section shape of the conductor, it is the same as that of the case where permittivity dependability, such as antenna internal loss shown in FIG. 14, is evaluated. In the example of FIG. 16, the section of a magnetic base is 3×3 mm in square, by changing the width of a square conductor, the cross-sectional area is changed. If the width of a conductor and the cross-sectional area become large and s/S becomes large, antenna internal loss will become low. If the width of a conductor is set to 0.5 mm or more, the cross-sectional area becomes 0.25 $mm^2$ or wider, and area ratio s/S becomes 0.029 or more, antenna internal loss will become almost constant.

Therefore, it is preferred that s/S is set to 0.029 or more (the width of a conductor is 0.5 mm or more, and the cross-sectional-area is set to 0.25 $mm^2$ or more). in this case, a ratio w/W is set to 0.17 or more. Here, W is the width of a magnetic base and w is the width of a conductor. When the width of a conductor is set to 0.7 mm or more, or the cross-sectional area is set 0.49 $mm^2$ or wider, or ratio s/S is set to 0.058 or more (w/W is set to 0.23 or more), antenna internal loss will be set to 0.5 dB or less. Therefore, it is still more preferred that s/S and w/W fulfill said conditions. On the other hand, although w/W is less than 1, if the width of a conductor becomes large, a magnetic path becomes narrow, inductance will fall and resonance frequency will become high. If the width of a conductor exceeds 1.0 mm, the thickness of a magnetic base is set to less than 1.0 mm, w/W exceeds 0.33 and area ratio s/S exceeds 0.125, resonance frequency will come to shift from the center of 470-770 MHz of ground-digital-broadcasting bands exceeding by 10%. Therefore, it is preferred that width w shall be 1.0 mm or less (cross-sectional area shall be 1.0 $mm^2$ or less) in this case.

It is preferred that ratio s/S shall be 0.125 or less (w/W shall be 0.33 or less). W is the minimum dimension in a direction right-angled to the longitudinal direction of a magnetic base here, and w is the minimum dimension in a direction right-angled to the longitudinal direction of a conductor. These are the length of one side, if a section is a square.

Material of a Magnetic Base

As a material of the aforementioned magnetic base, a spinel type ferrite, hexagonal ferrites such as Z type, and Y type and the compound material containing said ferrites materials can be used. As a spinel type ferrite, there are a Ni—Zn ferrite and a Li ferrite. As for this material, it is preferred that they are ceramics of a ferrite, and it is preferred to use the ceramics of Y type ferrite especially. Since the ceramics of a ferrite have high volume resistivity, they are advantageous at the point of aiming at the insulation with a conductor. If ferrite ceramics with high volume resistivity are used, the insulating cover layer is unnecessary between conductors.

In Y type ferrite, magnetic permeability is maintained to high frequency of 1 GHz or more. A magnetic loss in the frequency range up to 1 GHz is small. Therefore, it is suitable for the use in the frequency range over 400 MHz, for example, the chip antenna for ground digital broadcasting which uses a 470-770 MHz frequency range. In this case, it is preferred to use the ceramics of Y type ferrite as a magnetic base. As ceramics of Y type ferrite, not only Y type ferrite single phase but may contain other phases, for example, Z type, W type.

If ceramics have accuracy of dimension sufficient as a magnetic base after sintering, they do not need more processing, but as for a attached surface, it is desirable to give polish processing and to secure flatness.

Figure 17:
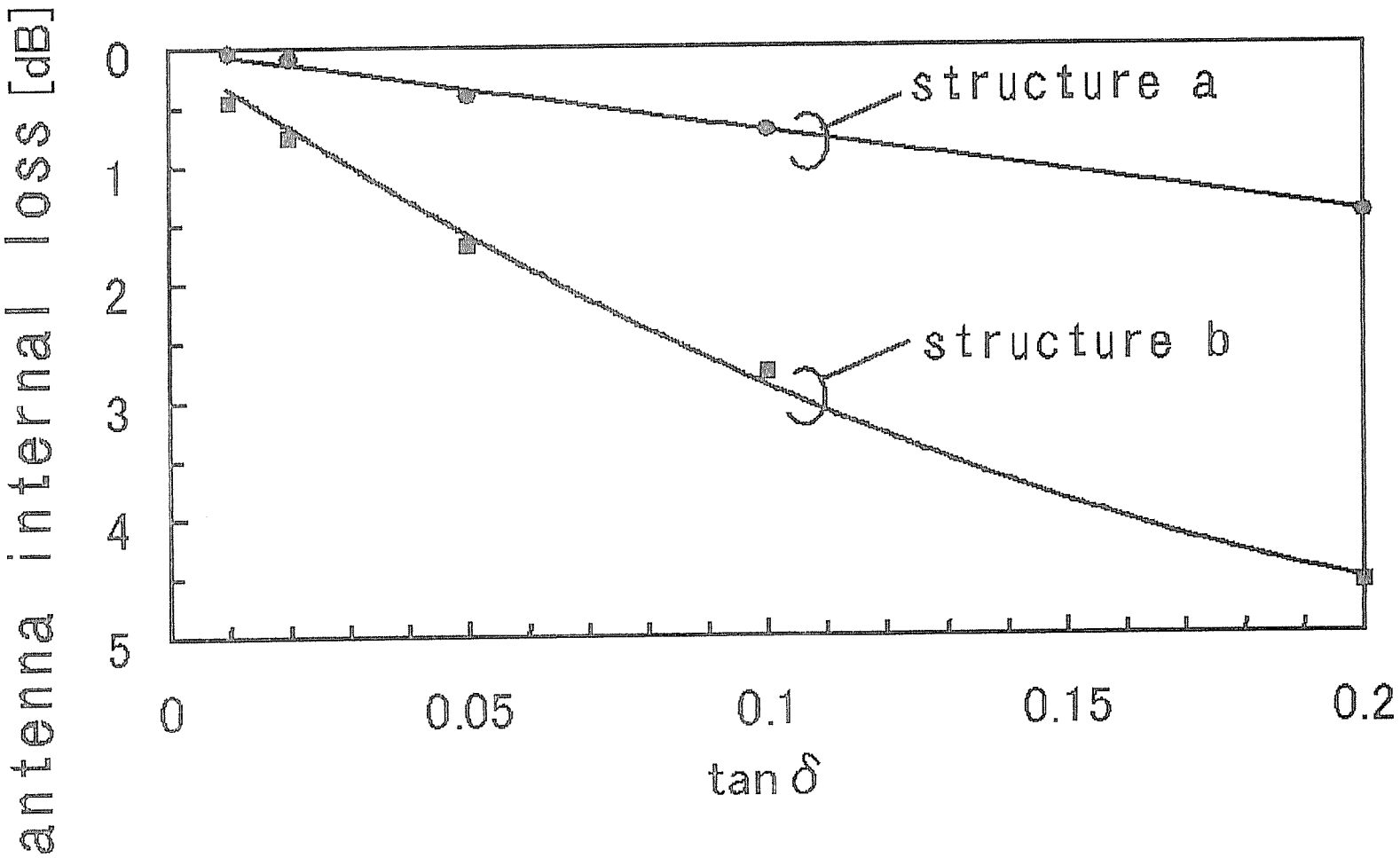
FIG. 17 shows the relation of the antenna internal loss and the loss factor tan δ in a structure (structure a) concerning an embodiment of the present invention, and a comparison structure (structure b).

If initial magnetic permeability at 1 GHz of the above-mentioned Y type ferrite is set to 2 or more, and a loss factor is set to 0.05 or less, it is advantageous when obtaining a chip antenna with wide bandwidth and high gain. If initial magnetic permeability becomes low too much, it will become difficult to make bandwidth wide. Moreover, if a loss factor, i.e., a magnetic loss, becomes large, the gain of a chip antenna will fall. The result of a measurement about the loss factor (tan δ) dependability of antenna internal loss, is shown in FIG. 17. Here, the antenna device of composition of being shown in FIG. 8 was used. Conditions other than loss factors, such as a dimension of magnetic base 1, are the same as that of the case where permittivity dependability, such as above-mentioned antenna internal loss, is evaluated. For comparison, evaluation result using the chip antenna which has an electrode of the helical structure, in which conductor width is set to 0.8 mm and the number of turns is set to 12 (structure b), is also shown. Antenna internal loss becomes small, so that a loss factor is small, as shown in FIG. 17. However, if these have the same loss factor, in the case of the structure (structure a) concerning this invention, antenna internal loss is sharply controlled rather than the case where it has an electrode of helical structure. For example, if loss factor tan δ is set or less to 0.05 in FIG. 17, antenna internal loss can be made into a low level of 0.5 dB or less. 0.5 dB in antenna internal loss corresponds to about 10% of transmission power. These characteristics are permissible as a loss only in a magnetic base.

Figure 18:
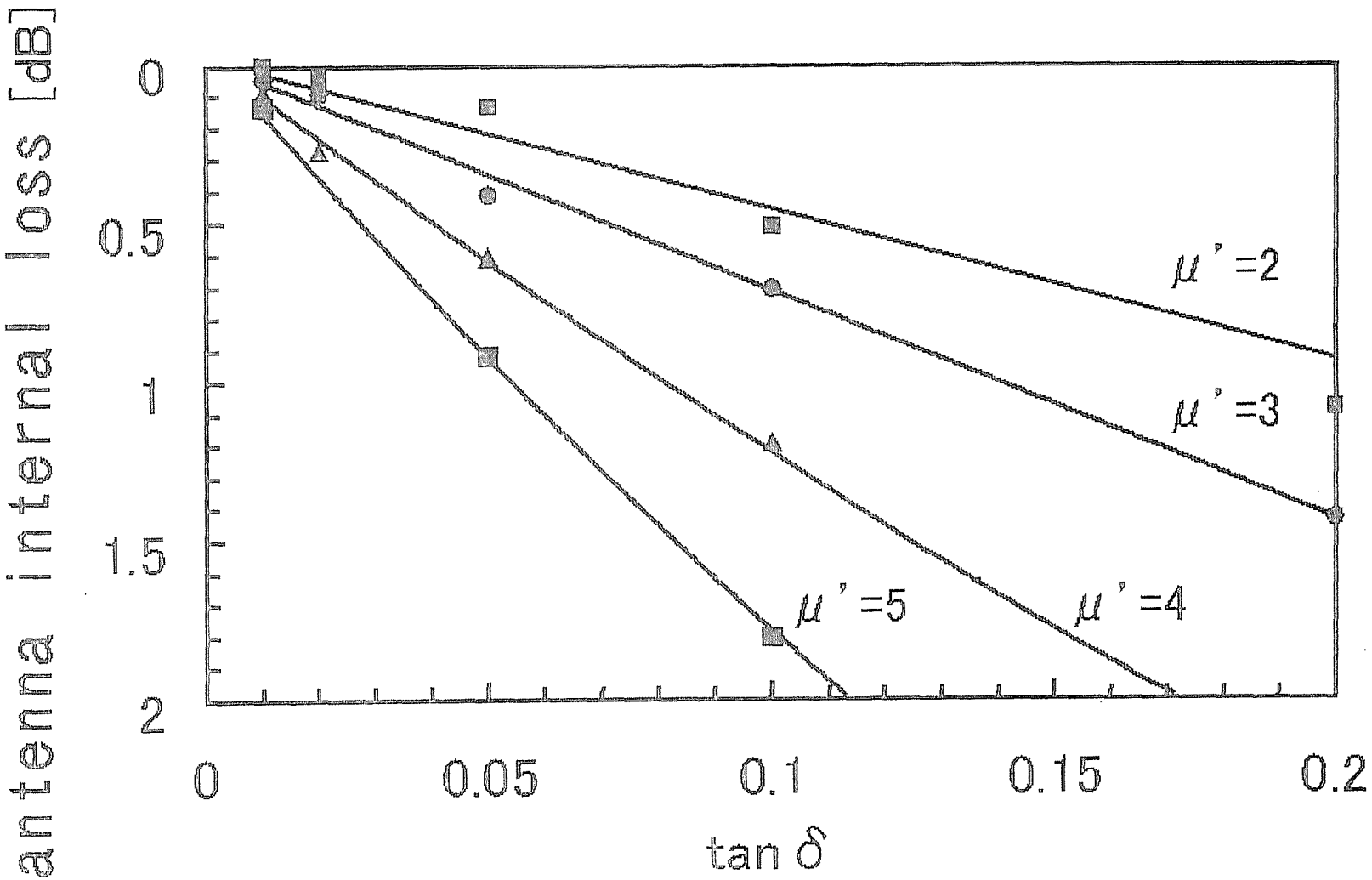
FIG. 18 shows the relation between the antenna internal loss and the loss factor tan δ.

The loss factor tan δ dependability of the antenna internal loss, changing initial magnetic permeability μ', is shown in FIG. 18. If initial magnetic permeability μ' becomes large, antenna internal loss will become large. However, in the case where initial magnetic permeability μ' is set to the range of 2-3, if loss factor tan δ is set to 0.05 or less, antenna internal loss can be made to 0.5 dB or less. Furthermore if a loss factor is set to 0.04 or less, even when initial magnetic permeability μ' is set to 4 or less, antenna internal loss can be made to 0.5 dB or less. Furthermore, if a loss factor is set to 0.03 or less, even when initial magnetic permeability μ' is set to 5 or less, antenna internal loss can be made to 0.5 dB or less. As for a loss factor, in order to obtain the average gain of −7 dBi or more as a chip antenna, loss factor of 0.05 or less are preferred. The chip antenna with especially high gain can be obtained, by setting a loss factor to 0.03 or less. Here, a loss factor becomes large as frequency becomes high. Therefore, if initial magnetic permeability μ' at 1 GHz of said Y type ferrite is set to 2 or more, and a loss factor is set to 0.05 or less, the chip antenna with high average gain over the whole frequency range up to hundreds of MHz, i.e., 1 GHz, can be offered. If the loss factor etc. is filling said range in each band used, it is possible to offer the chip antenna with high gain. For example, if initial magnetic permeability at 470 MHz and 770 MHz is set to 2 or more, and a loss factor is set to 0.05 or less, it is possible to apply to the ground digital broadcasting which uses a 470-770 MHz band. If initial magnetic permeability at 180 MHz is set to 2 or more, and a loss factor is set to 0.05 or less, it is possible to apply to the ground digital broadcasting which uses a frequency range higher than 180 MHz, for example, a 180-210 MHz band.

Y Type Ferrite Material

Y type ferrite is explained further. Y type ferrite is a soft ferrite of a hexagonal system typically expressed with the chemical formula of $Ba_2Co_2Fe_{12}O_{22}$ (what is called $Co_2Y$). The above-mentioned Y type ferrite makes M1O (here, M1 is kind of Ba and Sr at least), CoO, and $Fe_2O_3$ the principal component. Moreover, what replaced Ba of the above-mentioned chemical formula by Sr is included. Since Ba and Sr have the comparatively near size of an ionic radius, also Y type ferrite can be formed using Sr instead of Ba, similarly as using Ba. Moreover, similar characteristics are shown and each of these maintains magnetic permeability to a high frequency range. These mixed ratios just do Y type ferrite with the main phase.

For example, setting BaO to 20-23 mol %, CoO to 17-21 mol %, and $Fe_2O_3$ to remainder, is preferred. Furthermore, setting BaO to 20-20.5 mol %, CoO to 20-20.5 mol %, and $Fe_2O_3$ to remainder, is more preferred. Making Y type ferrite into the main phase means that the main peak intensity of Y type ferrite is the maximum among the peaks in X-ray diffraction. Although it is preferred that it is Y type single phase as for this Y type ferrite, other phases, such as other hexagonal ferrites, such as Z type and W type, and $BaFe_2O_4$, may be generated.

Therefore, in Y type ferrite, it is also permissible that these other phases are included.

However, in order to realize maintaining magnetic permeability to high frequency, with low loss factor, as for the ratio of Y type ferrite, it is desirable that it is 85% or more, and it is 92% or more preferably. The ratio of Y type ferrite means a rate of the main peak intensity of Y type ferrite to the sum of the intensity of the main peak (peak with the highest peak intensity) in the X ray diffraction of each phase which constitutes this ferrite material.

As for the Y type ferrite, it is preferred to contain Cu or Zn in a very small quantity further. Conventionally, $Cu_2Y$, $Zn_2Y$, etc. which used Cu or Zn instead of Co as a Y type ferrite are known. The substitution of this Cu or Zn mainly aims at the low-temperature sintering aiming at co-iring with Ag, and improvement in magnetic permeability. In this case, there are large amounts of substitution of Cu or Zn to Co as tens of % or more, and volume resistivity becomes low, and a loss factor and permittivity also become large.

On the other hand, in the case of this invention, the content of Cu or Zn is little. Ceramics density can be raised stopping a loss factor low and maintaining volume resistivity highly by making a little Cu or Zn contain. Magnetic permeability is also improved by making a little Cu or Zn contain.

The ceramics density more than $4.8\times10^3$ kg/m$^3$ can be obtained by setting content of Cu into 0.1 to 1.5% by weight by CuO conversion, and making content of Zn into 0.1 to 1.0% by weight by ZnO conversion. Loss factor tan δ in the frequency of 1 GHz is made to 0.05 or less, and also volume resistivity is made to $1\times10^5\Omega\cdot$m or more, by making content of Cu and Zn into the aforementioned range especially. The content of Cu and Zn is 0.1 to 0.6% of the weight in oxide conversion more preferably, and can make volume resistivity more than $1\times10^6\Omega\cdot$m in this case. The mechanical strength of the chip antenna used for communication equipment, such as a cellular phone, improves by using the magnetic base which has high density. When this magnetic base is used, antenna gain falls that volume resistivity is less than $1\times10^5\Omega\cdot$m. Therefore, it is desirable especially preferred that it is more than $1\times10^5\Omega\cdot$m, and volume resistivity is more than $1\times10^6\Omega\cdot$m.

Cu and Zn May Be Contained Simultaneously.

Si, Na, Li, Mn, etc. other than Cu and Zn can also be made to contain. Although Si brings about increase of ceramics density, and improvement in magnetic permeability, at less than 0.1% of the weight (by $SiO_2$ conversion), it is not effective. Since a loss factor will become large if the content increases, it is preferred that it is 0.1 to 0.4% of the weight. Although Na reduces a loss factor, at less than 0.1% of the weight by $Na_2CO_3$ conversion, an effect is not demonstrated, but volume resistivity falls at more than 0.4 mass %. Therefore, it is preferred that it is 0.1 to 0.4% of the weight in $Na_2CO_3$ conversion. Although L1 raises ceramics density and also raises magnetic permeability, at less than 0.1% of the weight by $Li_2CO_3$ conversion, an effect is not demonstrated for the content, but magnetic permeability and volume resistivity fall at more than 0.6 weight %. Therefore, 0.1 to 0.6% of the weight is preferred by $Li_2CO_3$ conversion. Although Mn reduces a loss factor, in less than 0.1%, an effect is not demonstrated, but volume resistivity falls at more than 1.0%. Therefore, it is preferred that it is 0.1 to 1.0% of the weight by $Mn_3O_4$ conversion.

B, which is an inescapable impurity, may be contained 0.001% or less of the weight. Similarly, Na may be contained 0.005% or less of the weight. Similarly, Si may be contained 0.01% or less of the weight. Similarly, P may be contained 0.005% or less of the weight. Similarly, S may be contained 0.05% or less of the weight. Similarly, Ca may be contained 0.001% or less of the weight.

Production Method of Y Type Ferrite

When making the ceramics of Y type ferrite into a magnetic base, this Y type ferrite can be produced by the powder metallurgy technique applied to production of the soft ferrite from the former.

Minor constituents, such as CuO and ZnO, are mixed with the main raw materials by which weighing capacity was carried out so that it might become desired composition, such as $BaCO_3$, $CO_3O_4$, and $Fe_2O_3$. In addition, minor constituents, such as CuO and ZnO, can also be added in the pulverization process after calcinations. A mixed method in particular is not limited. For example, wet blending (for example, for 4 to 20 hours) is carried out through pure water using a ball mill etc. Calcinated powder is obtained by calcinating of the obtained mixture at a predetermined temperature using an electric furnace, a rotary kiln, etc. As for the temperature and time of temporary sintering, 900-1300 degrees C. and 1 to 3 hours are desirable respectively. If the temperature and time of temporary sintering are less than these, a reaction will not fully progress.

On the contrary, if it exceeds these, pulverization efficiency will decrease. As for the atmosphere in temporary sintering, it is desirable that it is under the oxygen existence in the atmosphere or oxygen etc.

Wet pulverization of the obtained temporary sintering powder is carried out using, a ball mill, etc., and binders, such as PVA, are added. Then, granulated powder is obtained with a spray dryer etc. As for the average particle diameter of granulated powder, 0.5-5 micrometers is desirable.

The obtained granulated powder is molded with a pressing machine. Then, after sintering in oxygen environment at the temperature of 1200 degrees C. for 1 to 5 hours, using an electric furnace etc., hexagonal ferrite is obtained. 1100-1300 degrees C. of sintering temperature are preferred. Sintering is not fully performed as it is less than 1100 degrees C., and a high ceramics density is not obtained. If it exceeds 1300 degrees C., a exaggerated grain will be generated and it will become fault sintering.

Moreover, if sintering time is short, sintering will not fully be performed. On the contrary, as for this time, since it will be easy to become fault sintering if sintering time is long, 1 to 5 hours is desirable. Moreover, as for sintering, in order to obtain a high ceramics density, it is desirable to carry out under oxygen existence, and it is more desirable to carry out in oxygen. Cutting, polish, slot processing, etc. are processed to the obtained ceramics if needed.

Embodiment 1 of an Antenna

The example of an antenna is explained below. First, the antenna shown in FIG. 1 is explained further in full detail. In this composition, the straight shape conductor penetrates the magnetic base. Here, a magnetic base and a conductor may be formed as one. For example, it can be formed by the method currently indicated by Japanese Patent No. H10-145123. where lead wire is arranged into the powder of a magnetic material, compression molding is carried out and it is sintered after.

Sintering time can be shortened if microwave sintering is adopted as sintering as a heating method besides the usual heating sintering. In this case, the reaction of a conductor and magnetic material powder can be suppressed.

The lamination process of laminating a green sheet can also be used as a method of forming a magnetic base and a conductor by one. Sheet forming of the mixture of magnetic material powder, a binder, and a plasticizer is carried out by the doctor blade method etc., a green sheet is obtained, this green sheet is laminated and a laminated body is acquired. The conductive paste which contains Ag, Ag—Pd, Pt, etc. on the green sheet which will be located in the center section of this laminated sheet, is printed in the shape of a straight line. Thereby, the magnetic base which the straight line-shaped conductor has penetrated can be obtained.

However, it is necessary to take about wiring from the conductor of the above-mentioned straight line form to the exterior of a magnetic base in this case. For this reason, it is necessary to form a surface electrode on the surface of a magnetic base by printing, baking, etc.

Embodiment 2 of an Antenna

On the other hand, a magnetic base and a conductor may be formed independently. In this case, as composition of a chip antenna, a through-hole is provided in a magnetic base and a conductor is formed into this through-hole. When forming a magnetic base and a conductor independently, the influence of the reaction between a magnetic base and a conductor can be eliminated. Therefore, flexibility of a design and the accuracy of dimension of a conductor can be raised. When a magnetic base is formed with ferrite ceramics, this magnetic base can be produced by the usual powder-metallurgy technique. As a method of forming a through-hole in this magnetic base, the method of forming a through-hole by machining can be used. The molded object having a through-hole in it by the compression molding method or an extrusion-molding method, may be produced, and this may be sintered. When producing a long magnetic base, two or more short magnetic bases may be accumulated making through-holes counterpose. The magnetic base which comprised a curved surface as shown in FIG. 12 can also be produced by the compression molding method or an extrusion-molding method. It may be processed in the state of ceramics, and also may be processed in the state of a molded object.

The section shape of a through-hole is not limited in particular. For example, this shape can be set to circular and a quadrangle. In order to make insertion of a conductor easy and to make the interval of a magnetic base and a conductor small, it is preferred to make section shape of a through-hole similar to the section shape of a conductor. Although a gap may be between a magnetic base and a conductor, inductance decreases by existence of this gap. Therefore, it is desirable for this gap to be small enough to the thickness of a magnetic base. As for this gap, it is preferred that it is 50 micrometers or less at one side. It is preferred that the section shape of a through-hole and the section shape of a conductor are almost the same in the state which a conductor can insert in this through-hole. It does not depend for the above matter on the formation method of a through-hole. When the section shape of a through-hole is circular, 50 micrometers or less of deviation from cylindrical form (difference of an maximum overall diameter and a minimum diameter), are preferred. If this deviation from cylindrical form becomes large, when inserting a conductor in the through-hole of a magnetic base, a minimum diameter will become small, compared with the diameter set up as a perfect circle. In this case, insertion of a conductor becomes difficult. Therefore, it will be necessary to set up a diameter more greatly with a margin. However, in this case, the gap increases and inductance decreases. Therefore, this deviation from cylindrical form shall be 10 micrometers or less more preferably. On the other hand, in the case of the structure where a straight shape conductor penetrates a magnetic base, as for the straightness (gap width of the through-hole section in alignment with the longitudinal direction of the through-hole), it is preferred that it is below the diameter of a through-hole.

Figure 3:
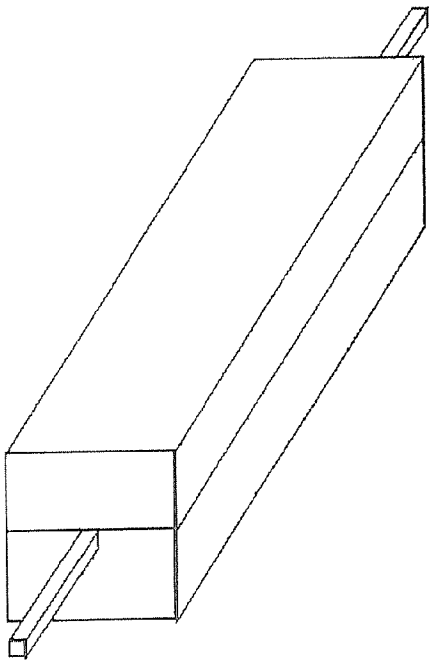
FIG. 3 shows another embodiment of the chip antenna of the invention.
Figure 3:
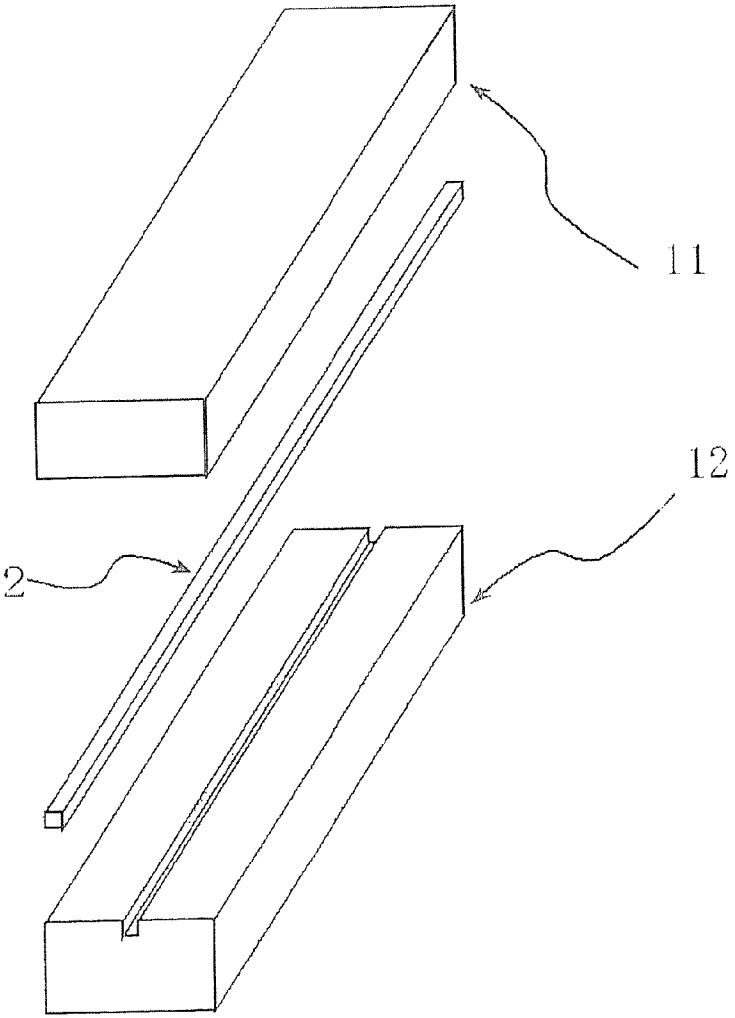

An example in which the composition shown in FIG. 1 using the magnetic base and conductor formed separately, was realized, is shown in FIG. 3. The example shown in FIG. 3 is an embodiment in which a rectangular parallelepiped-like magnetic base comprises two or more members, and the through-hole is formed of the combination of two or more of said members. At (a) in FIG. 3, the magnetic base comprises magnetic member 12 in which the slot was established in order to insert a conductor, and magnetic member 11 for pasting together to this magnetic member 12 across this slot.

Conductor 2 is inserted in the slot of magnetic member 12, and also magnetic member 11 is pasted together, and it fixes, and becomes a chip antenna (FIG. 3(*b*)). A conductor may be inserted in the formed through-hole after pasting magnetic member 12 and magnetic member 11 together. A through-hole will be formed by pasting magnetic member 12 and magnetic member 11 together in both cases. These slots can be formed with sufficient accuracy, if a dicing process is used, for example. In the example of FIG. 3, since a member is pasted together and it finishes setting up a base after performing easy slot processing, a through-hole can be formed very simply. The section shape of a slot is determined that insertion of this conductor is attained according to the section shape of a conductor. This slot depth is set up so that this conductor may not overflow the upper surface of this slot. In the example of FIG. 3, although the slot is formed in one side of a magnetic member, a through-hole may be formed by forming a slot in both magnetic members, making the slots face to face, and pasting together. In this case, positioning of both magnetic members is made by the conductor inserted.

Embodiment 3 of an Antenna

Figure 4:
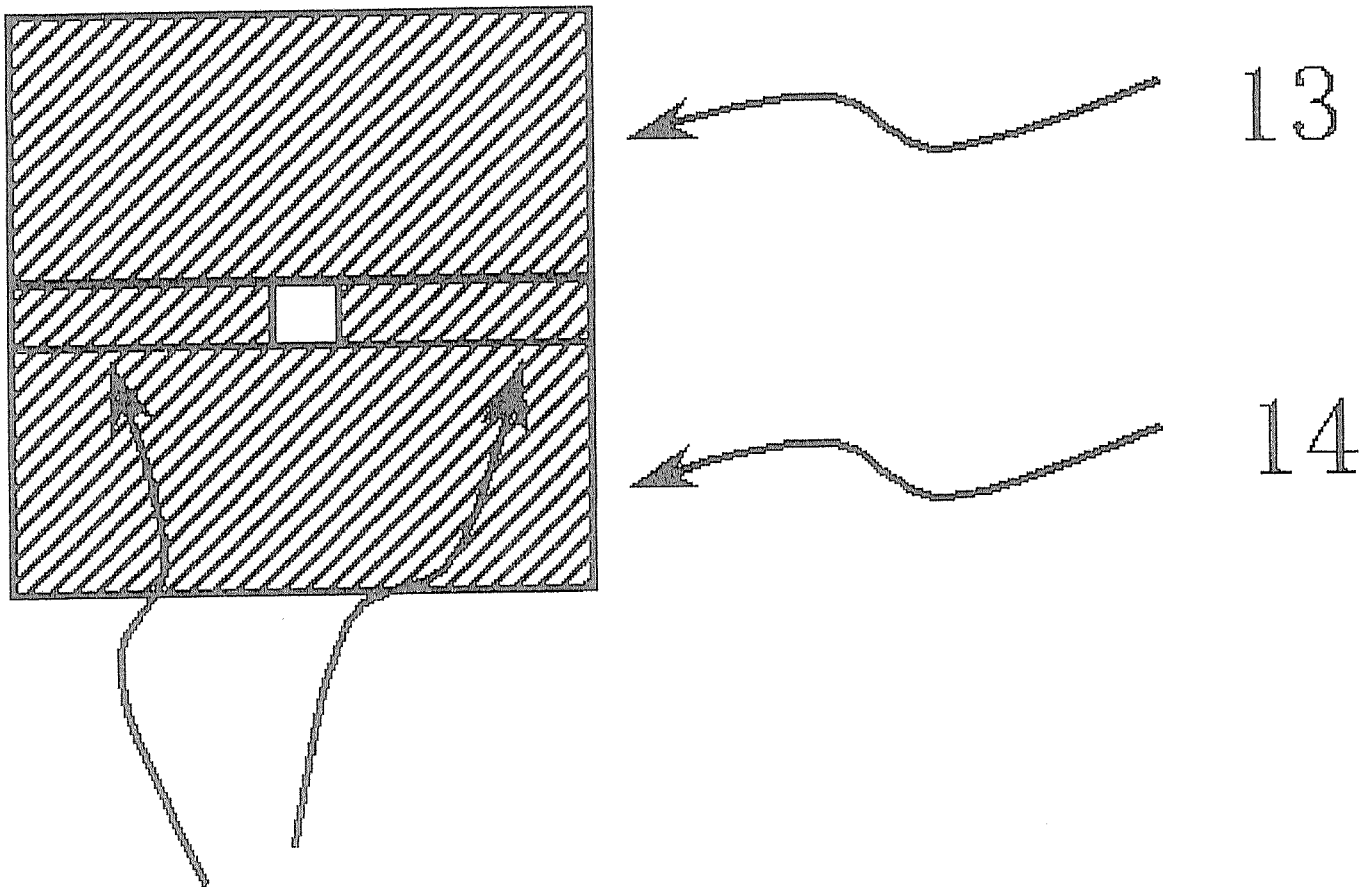
FIG. 4 shows another embodiment of the chip antenna of the invention.

FIG. 4 shows other embodiments in which a magnetic base comprises two or more members, and the through-hole is formed of the combination of two or more of said members. FIG. 4 is a sectional view of a direction perpendicular to a longitudinal direction. A magnetic base takes rectangular parallelepiped shape and it comprises pinching magnetic member 15 by magnetic members 13 and 14. Both magnetic members 13, 14, and 15 take rectangular parallelepiped shape. A through-hole is formed because two magnetic members 15 have a predetermined interval. The shape and dimension of a through-hole are determined by the interval and thickness of two magnetic members 15. As a concrete assembly procedure for example, magnetic member 15 is arranged on both sides of conductor 2 on magnetic member 14, and also magnetic member 13 is put, and these are fixed where magnetic member 14 and conductor 2 are inserted by magnetic members 13 and 14. In the composition of FIG. 4, slot processing cannot be needed, but a magnetic member can be produced only by easy processing, and a through-hole can be formed. Therefore, a chip antenna is produced especially simply.

Embodiment 4 of an Antenna

It is possible to perform fixation with a magnetic base and a conductor and fixation of magnetic members using a clamp etc. However, adhering is preferred in order to certainly fix these. For example, when adhering a magnetic base and a conductor, adhesives are applied to the gap between a magnetic base and a conductor, and it adheres to it. When adhering in magnetic members, adhesives are applied to a pasting side and it pastes up. As for the thickness of an adhesives layer, since a gap will become large if an adhesives layer becomes thick, 50 micrometers or less are preferred. This thickness may be 10 micrometers or less more preferably. In order to suppress formation of a magnetic gap, adhesives may be applied to portions other than a pasting side, and it may adhere to them. For example, on the side, adhesives are applied so that the pasting portion of a magnetic member may be straddled. As adhesives, resin, inorganic adhesives, etc., such as thermosetting and ultraviolet curing nature, can be used. Resin may be made to contain magnetic material fillers, such as an oxide magnetic material. It is desirable to use adhesives with high heat resistance, in consideration of the case where solder fixation of the chip antenna is carried out. Especially when applying the reflow process at which the whole chip antenna is heated, the heat resistance against 300 degrees C. or more, is preferred. In addition, when the gap between a magnetic base and a conductor is small, and when a motion of the conductor prepared in the through-hole of the magnetic base is fully restrained by a magnetic base, it is not necessary to use a fastener means between a magnetic base and a conductor.

Embodiment 5 of an Antenna

Figure 19:
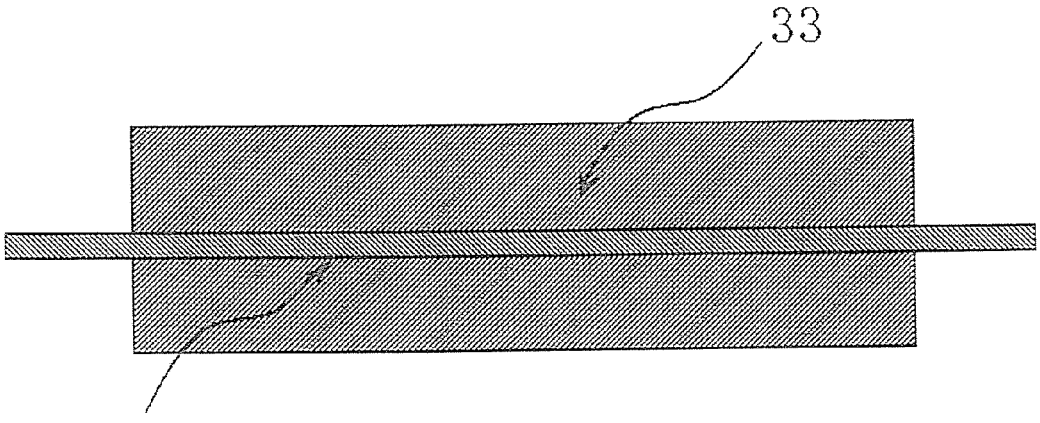
FIGS. 19(*a*)-19(*b*) show another embodiment of the chip antenna of the invention.
Figure 19:
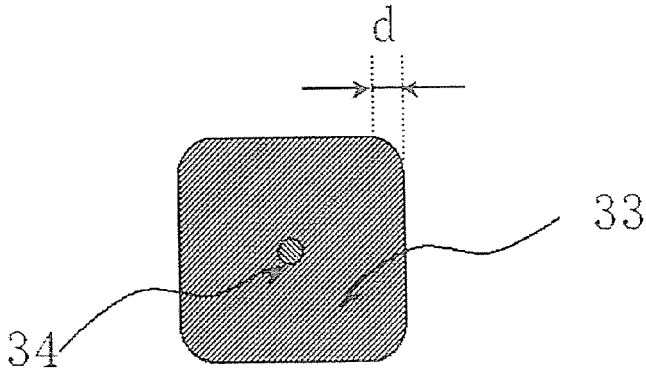

Next, other examples in which this composition was realized using the magnetic base and conductor formed separately, are shown in FIG. 19. (a) in FIG. 19 is the sectional view which contained the conductor along with the longitudinal direction. (b) is a sectional view in a direction perpendicular to a longitudinal direction. In the example shown in FIG. 19, magnetic base 33 taking rectangular parallelepiped shape comprises a single member. Conductor 34 with a circular section was inserted in the through-hole of this magnetic base 33, and it has penetrated.

Since there is no joining section when using the magnetic base which comprised a single member, it is advantageous when the mechanical strength of a chip antenna is needed. As this magnetic base, what was obtained by extrusion molding is preferred. According to extrusion molding, it is possible to produce a long magnetic base, especially the magnetic base which has a through-hole in a longitudinal direction.

In extrusion molding, the kneaded materials are pushed out continuously. In this case, in ceramics, the trace of the boundary of granulated powder does not remain, unlike the case of carrying out compression molding of the granulated powder. Therefore, high mechanical strength can be made also in the long magnetic base which has a through-hole.

Especially, since it is possible to sinter after forming a through-hole at the time of extrusion molding, the inner wall side of the through-hole can be constituted from sintered surface, and generation of a defect can be restricted. The antenna of this composition is preferred when using for the portable devices (cellular phone etc.) with which strong external force, such as an impact by fall, may be added.

Extrusion molding is performed by pushing out continuously the forming object of the section shape corresponding to the shape shown in FIG. 19(*b*). This forming object is cut and sintered by predetermined length. The example shown in FIG. 19 is the composition of having provided the radius of curvature in the corner located in the direction perpendicular to the longitudinal direction of rectangular parallelepiped shape as beveling, and d has shown the width of beveling. Said composition is produced by providing a radius of curvature in the corner of a die in the case of fabrication.

Embodiment 6 of an Antenna

Figure 20:
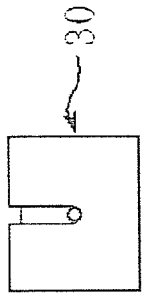
FIGS. 20(*a*)-(*c*) show another embodiment of the chip antenna of the invention.
Figure 20:
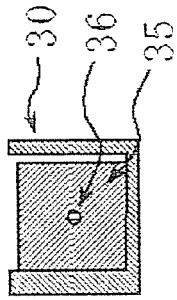
Figure 20:
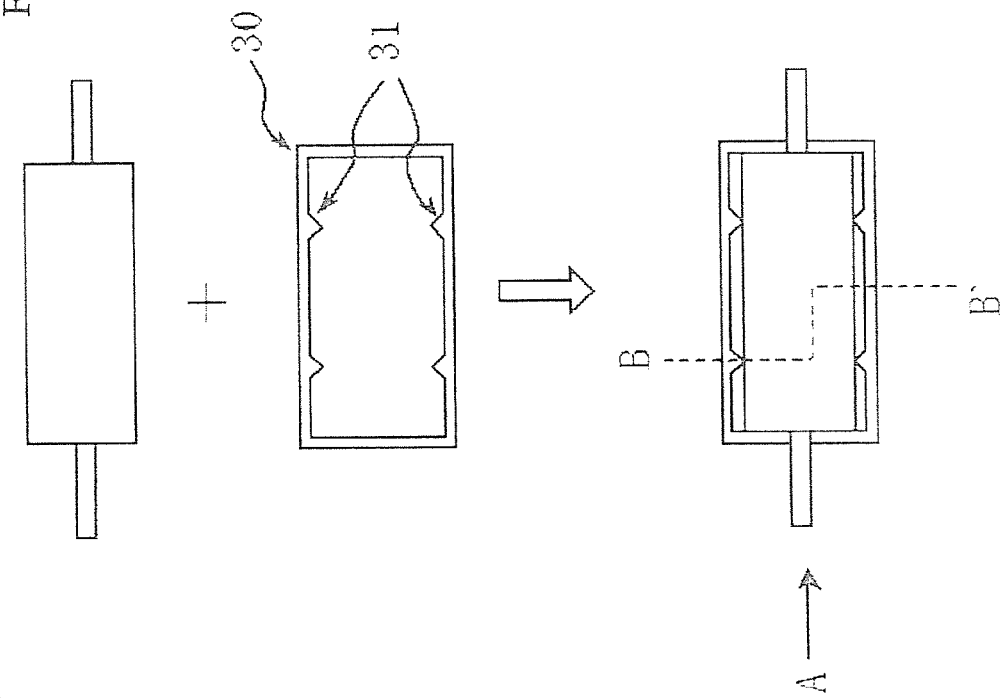

Next, other embodiments of the chip antenna applied to this invention in FIG. 20 are shown in a figure. The example shown in FIG. 20 is a chip antenna accommodated in the case. FIG. 20(*a*) shows the top view of the chip antenna accommodated in case 30 and said case 30 made of resin. (b) in this figure is the side elevation seen from the direction of A in FIG. 20(*a*). FIG. 20(*c*) is a sectional view in the B-B' line in (a) in FIG. 20.

Case 30 has the space in which a chip antenna can be accommodated in a depth direction. In the both side surfaces, the slit is provided ranging from the upper surface to a center. This slit enables derivation of conductor 36 with a circular section to case outside from a case interior. A through-hole may be provided instead of a slit.

It is not necessary to provide said slit or said through-hole in both side surfaces, and it may be provided in the side of one side. A chip antenna is restrained between the case inner side end faces. In two place in the longitudinal direction of each chip antenna, protrusion 31 which restrains a motion of the right-angled direction to the longitudinal direction of a chip antenna, is formed in a case inner wall.

In the example of FIG. 20, said protrusion 31 is formed along the depth direction in pillar-shaped, and restrains a chip antenna by a line. The section shape of a pillar-shaped protrusion is not limited in particular. This shape can also be made into the shape for example, of a triangle, and the shape of a semicircle. It may restrain at a point by making a protrusion into point shape.

Instead of providing a protrusion, the almost same space as the shape of a chip antenna may be provided, a chip antenna may be fitted in this space, and a motion of a chip antenna may be restrained.

The depth in particular of this case is not limited. In order to protect magnetic base 35, it is larger than the thickness of a magnetic base, and it is preferred that a magnetic base does not protrude from the case upper surface. A chip antenna may be fixed to a case with adhesives.

Embodiment 7 of an Antenna

Figure 21:
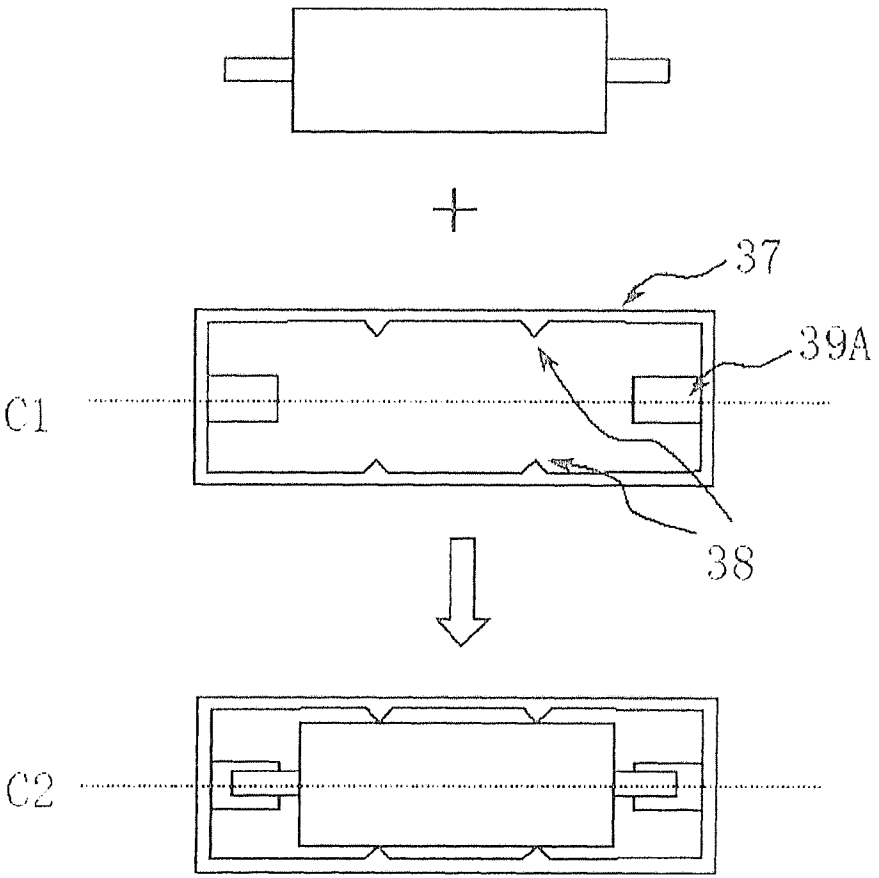
FIGS. 21(*a*)-(*c*) another embodiment of the chip antenna of the invention.
Figure 21:
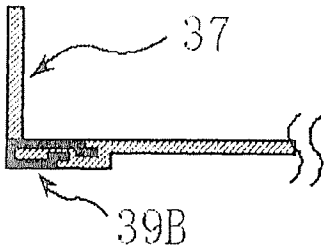
Figure 21:
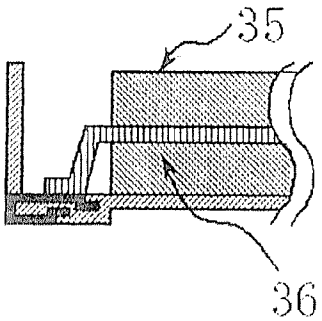

In FIG. 21, another embodiment by which the chip antenna is accommodated in the case is shown. Protrusion 38 is the same as that of the embodiment shown in FIG. 20. (b) in FIG. 21 and (c) are the sectional views of the dotted line portions of C1 and C2 of (a) in FIG. 21, respectively.

According to the embodiment shown in FIG. 21, the conductor member is provided in the lateral surface of case 37. In the both side surfaces of case 37, from a central soffit to a bottom side edge, conductor member 39B is formed, specifically. Using this conductor member 39B, the case and the conductor part in a substrate etc., can be joined, and a chip antenna can be fixed.

In the composition shown in FIG. 21, conductor member 39B is further installed in a case interior from the case side, and forms conductor member 39A in the case interior. Conductor members 39A and 39B are united, and are electrically connected. The end of conductor members 39A and 39B is interpolated inside of a resin case. This case can be formed by carrying out the resin molding of the conductor member made from phosphor bronze, for example.

In the example shown in FIG. 21, conductor member 39A connected to conductor member 39B provided in the external surface of the case was formed in the both ends of the bottom of a case interior, and the conductor of a chip antenna is connected to this conductor member 39A by soldered joint (not shown). With this composition, fixation of a chip antenna, and electric connection of a chip antenna with other circuits, etc., can be made using said conductor member 39B. In the example shown in FIG. 21, conductor member 39B is formed along the external surface of case 37. However, the form made to protrude from a case by making this conductor member into pin shape, can also be used.

Instead of using conductor member 39A, the metal plate with which the slit was formed from the upper part can be set up from a case bottom side, and the composition which makes this metal plate pinch the linear conductor protruding from the magnetic base in said slit, can also be used. In this case, it is preferred to form this metal plate and said conductor member 39B by one, or to join these electrically. If width of said slit is made smaller than the width or the diameter of said linear conductor, fixation and electrical connection of a chip antenna can be performed.

It may be made for the width of a slit to gradually decrease in a depth direction. Width of the upper limit in a slit can be made smaller than the width of the central part where this conductor is inserted, in this case, this linear conductor is hung. Conductor member 39A in a case interior is not necessarily required, and if the conductor member is provided in lateral surfaces of the case, such as the side and the bottom, it is possible to mount the chip antenna which was joined to the conductor part in a substrate etc. and was accommodated in the case. In this case, the conductor member protruding from the magnetic base is made to extend besides a case, and what is necessary is just to perform electrical connection to the electrode besides a case etc.

A lid member may be provided in the case upper part. Adhesion fixing of this lid member may be carried out with adhesives, and this lid member may use the composition hung on a case, also this lid member can be made to hang in a case. The whole chip antenna can be protected by providing this lid member. In addition to formation of an above-mentioned protrusion, or instead of the protrusion, a chip antenna can also be made to restrain using said lid member. In an above-mentioned example, this chip antenna is fixed and protected by using a case, instead, a chip antenna is also fixable using the mold material which consists of resin.

Embodiment 1 of an Antenna Device

Next, an antenna device is explained. When the chip antenna shown in FIG. 1 is used, one end 3 of said conductor constitutes an open end, other end 4 is connected to control circuits (not shown), such as a feeder circuit, and an antenna device is constituted. Although the fixation to the electrode of the end which is an open end side in this conductor etc. is unnecessary, for stable mounting or adjustment of resonance frequency, it is preferred to also fix the open end side to an electrode etc.

Figure 2:
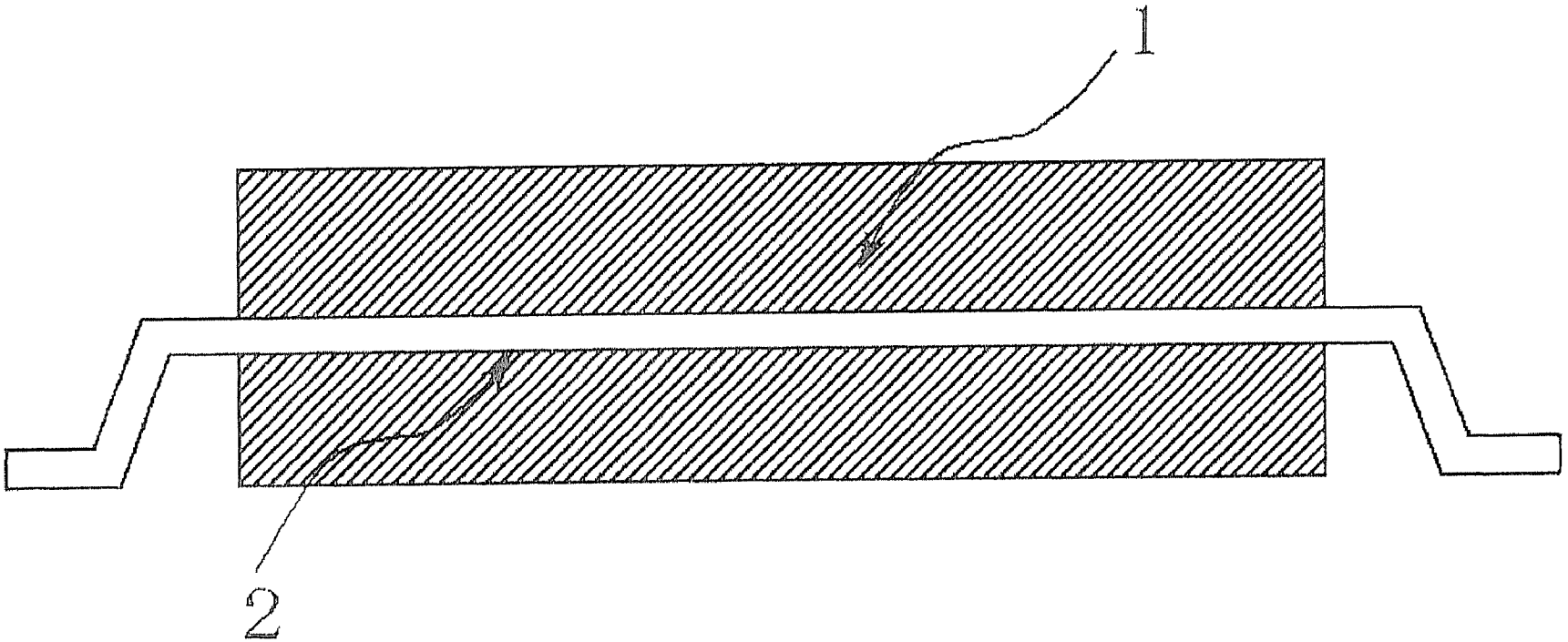
FIG. 2 shows another embodiment of the chip antenna of the invention.
Figure 5:
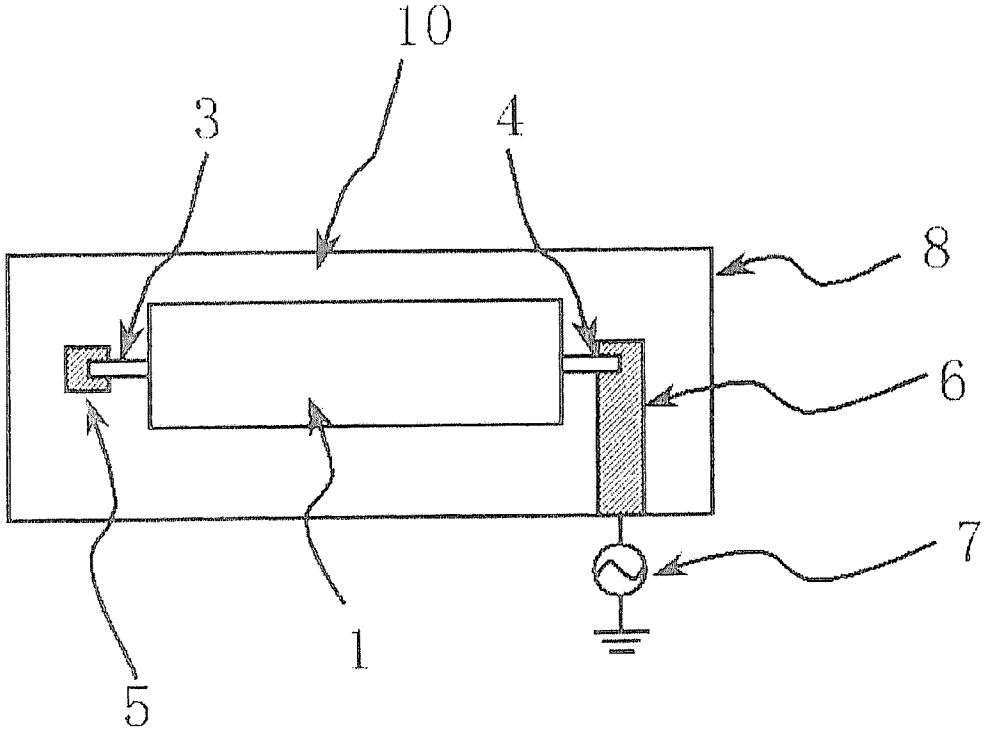
FIGS. 5(*a*)-5(*b*) show an embodiment of the antenna device of the invention.
Figure 5:
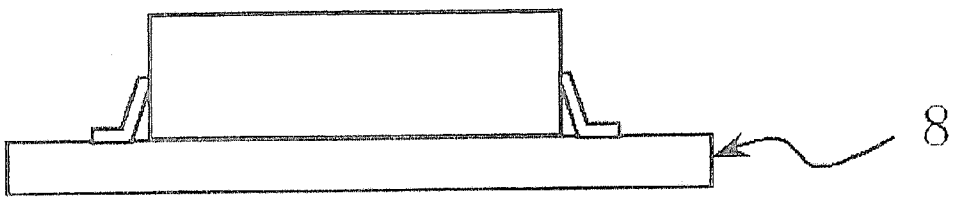

FIG. 5 is a figure showing the example of the embodiment of an antenna device which mounted the chip antenna of FIG. 2 in the substrate. FIG. 5(*a*) is the top view seen from the direction perpendicular to the field of a substrate. FIG. 5 (*b*) is the back elevation seen from the direction parallel to the field of a substrate. Illustration of the electrode on a substrate is omitted in FIG. 5 (*b*). This antenna device is provided with a chip antenna and substrate 8 which mounts said chip antenna.

In this chip antenna, straight shape conductor 2 penetrated magnetic base 1, and the both ends of said conductor, i.e., one end 3 and other end 4, have protruded from said magnetic base. The both ends of this conductor 2 are crooked outside said magnetic base, and are connected by solder to fixing electrode 5 and feed electrode 6 which are electrodes formed in substrate 8. The feed electrode is connected to the feeder circuit etc. In chip antenna 10, since it is arranged so that the longitudinal direction in conductor 2 may become parallel to a substrate plane, thin and stable mounting is enabled. These are the same as the antenna device of other embodiments mentioned later.

In chip antenna 10, since the both ends of the conductor are being fixed with solder, it is being fixed firmly, furthermore, it may be fixed using adhesives etc. Although the both ends of the conductor were made bended and it has connected to the electrode on a substrate with the composition shown in FIG. 5, without making the both ends of a conductor bended, fixing electrode 5 and feed electrode 6 in a substrate may be thickened, and may be connected. Any mode of a receiving antenna, a transmission antenna, and transmitting antennas can use an antenna device.

Embodiment 2 of an Antenna Device

Figure 6:
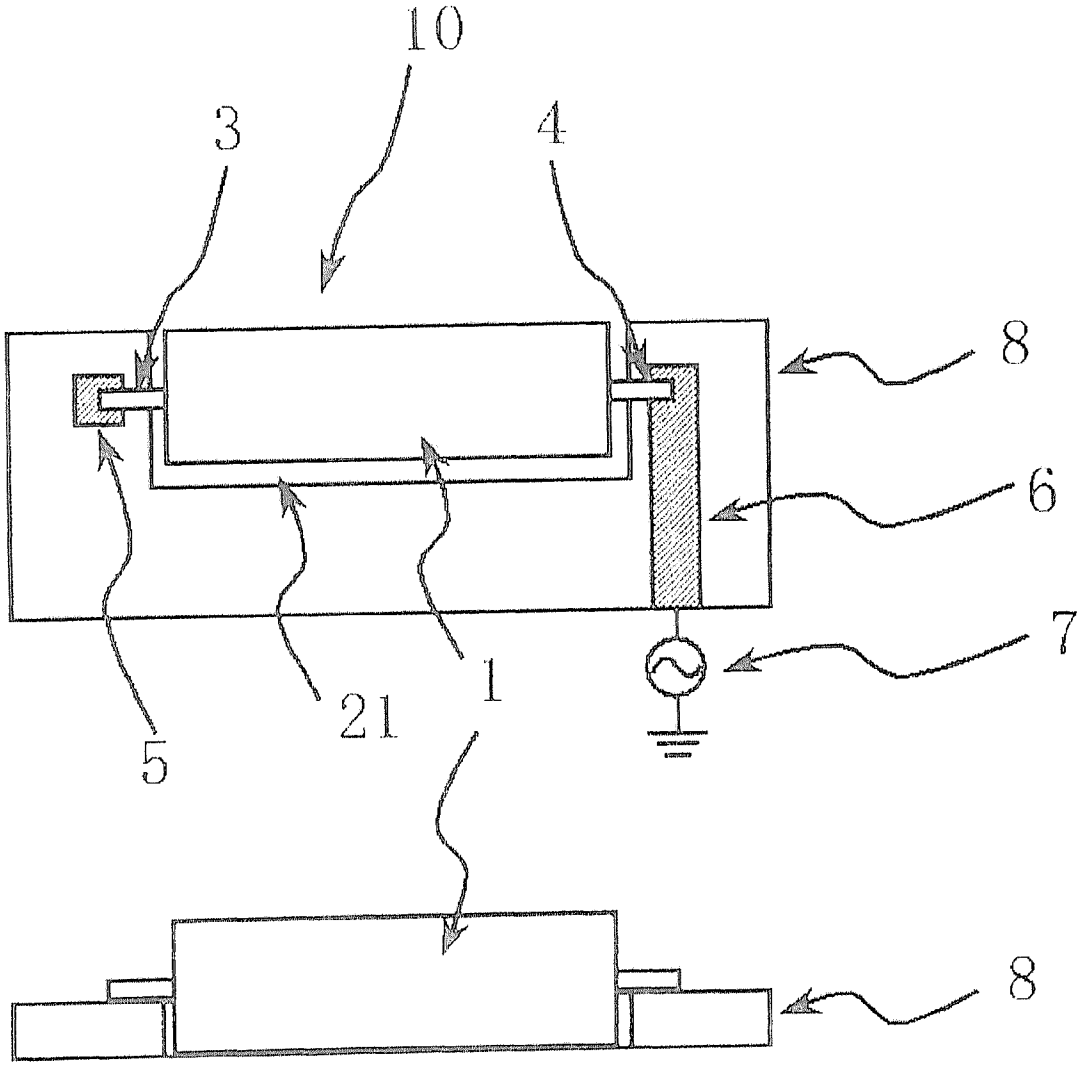
FIGS. 6(*a*)-6(*b*) show another embodiment of the antenna device of the invention.

Other embodiments of the antenna device of this invention are shown in FIG. 6. FIG. 6 is a figure showing the example of the antenna device which mounted the chip antenna of FIG. 1 in the substrate. FIG. 6(*a*) is the top view seen from the direction perpendicular to the field of a substrate. FIG. 6(*b*) is the back elevation seen from the direction parallel to the field of a substrate. Illustration of the electrode on a substrate is omitted in FIG. 6(*b*). The antenna device shown in FIG. 6 is provided with substrate 8 which mounts chip antenna 10 and the chip antenna 10.

In chip antenna 10, the straight shape conductor 2 penetrates the magnetic base 1, and the both ends of the conductor 2, i.e., one end 3 and the other end 4, protrude from the magnetic base 1. A notch section 21 is formed in the substrate 8. The base in chip antenna 10 is inserted in the notch section. The both ends 3, 4 of the conductor 2 are connected by solder, to the electrode formed in the substrate.

Although it is possible to also make the both ends of the conductor 2 bent, it is preferred to set it as linear shape. The both ends of the protruding conductor 2 are made into linear shape in the example of FIG. 6. In the embodiment of FIG. 6 where the notch section was provided in the substrate, it is possible to mount a chip antenna, while the both ends of protruding conductor 2 have been straight shape. Therefore, the process which makes the both ends of conductor 2 bended can be skipped, and a manufacturing process can be simplified. As shown also in a back elevation in FIG. 6(*b*), the part of a base along the thickness direction can be dedicated to the notch section of a substrate. Therefore, this antenna device can be made thin. In this case, as conductor 2, what has sufficient mechanical strength for support of a chip antenna and hardness is used.

As this material, 42 alloys, covar, phosphor bronze, the Corson copper alloy, etc. can be used, for example. In the embodiment in FIG. 6, the notch section is constituted by providing the portion which inserts a base in a substrate end. Instead, opening may be formed in a substrate and a base may be made to insert in this opening. The similar effect can be obtained, as the case that a notch section is formed.

Embodiment 3 of an Antenna Device

Figure 7:
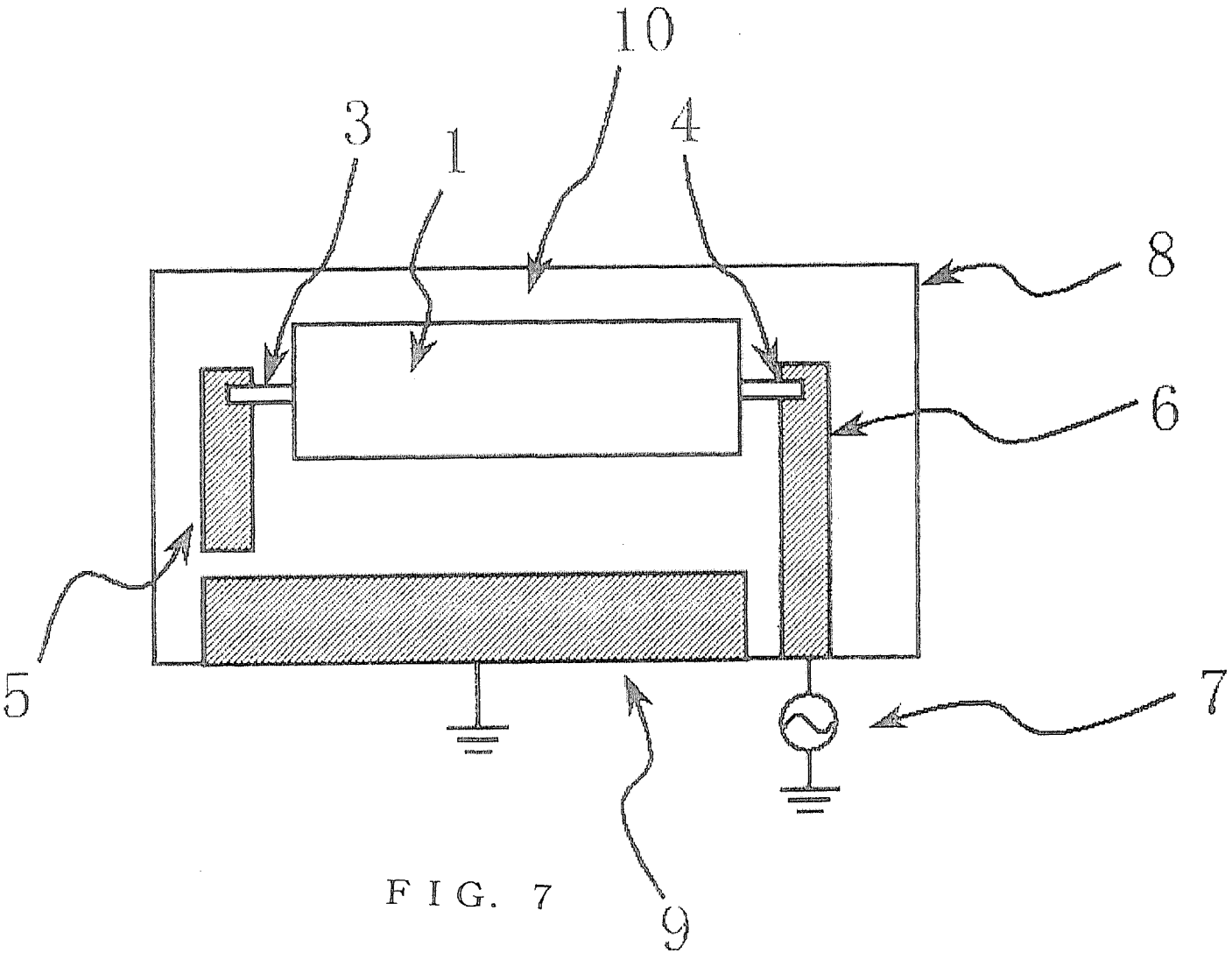
FIG. 7 shows another embodiment of the antenna device of the invention.

Next, another embodiment of the antenna device of this invention is described using FIG. 7. The antenna device shown in FIG. 7 has a substrate 8 which mounts the chip antenna 10 shown in FIG. 2, and said chip antenna. In the substrate 8, a ground electrode 9 and a fixing electrode 5 are formed.

The ground electrode 9 and the fixing electrode 5 are separated. One end 3 of the conductor in the chip antenna 10 is connected to the fixing electrode 5. The other end 4 of this conductor is joined to the feed electrode with solder, and this feed electrode is connected to the feeder circuit etc. Fixing electrode 5 extends in the direction perpendicular to the longitudinal direction of the conductor in chip antenna 10. The end of fixing electrode 5 and the end of ground electrode 9 are parallel, and it faces each other at the predetermined intervals.

According to the embodiment in FIG. 7, chip antenna 10, fixing electrode 5, ground electrode 9, and feed electrode 6 are arranged at rectangular shape. In chip antenna 10, capacity is formed among these by separating fixing electrode 5 by the side of an open end from ground electrode 9.

This chip antenna has the structure which reduced capacity. When capacity is insufficient to desired antenna characteristics, antenna characteristics can be adjusted by adding capacity by said method. Compared with the method of adjusting the capacity of the chip antenna itself, capacity can be simply adjusted with said method. As a concrete method of adjusting the resonance frequency of an antenna, at least one capacitor and switch are connected, and these can be switched between fixing electrode 5 and ground electrode 9. Or a variable capacitance diode (varactor diode) is connected, and it can adjust to predetermined resonance frequency, changing electrostatic capacity with this applied voltage.

Widening of Bandwidth of an Antenna Device

In the chip antenna concerning this invention, since a magnetic material is used as a base, the wavelength shortening effect is great, it is easy to miniaturize it, and wide bandwidth can be taken also in high frequency. Therefore, the chip antenna is preferred as a chip antenna used for a frequency range (180 MHz or more used for South Korean ground digital broadcasting, and also 400 MHz or more). Also, it can be used for digital radio system, in which bandwidth of 189 MHz 197 MHz, is used. By constituting an antenna device using the chip antenna concerning this invention, the frequency range of an antenna device can be made wide.

It is also possible to obtain the bandwidth of 220 MHz or more with average gain more than −7 dBi. It is also possible by adjusting resonance frequency to obtain the bandwidth of 300 MHz or more. The antenna device which has the wide bandwidth applied in a high frequency band of 400 MHz or more, is suitable for the use which needs a wide frequency range, for example, ground digital broadcasting of Japan. Like the ground digital broadcasting which uses a 470-770 MHz frequency range, the bandwidth to be used may be wide to the bandwidth of an antenna device.

In this case, two or more these antenna devices with which frequency ranges differ can be used simultaneously. If two or more antenna devices are used, a packaging surface and mounting space will increase, but if the bandwidth of an antenna device is wide, the number of antenna devices can be reduced. Especially, when using three or more antenna devices, a packaging surface and mounting space will increase. Therefore, in the case of the portable device etc., with which the packaging surface is restricted, the two or less number of antenna devices is preferred, one more preferably.

It is also possible to receive a 470-770 MHz frequency range using two or less antenna devices. As an average gain of an antenna device, −7 dBi or more is preferred, or −5 dBi or more preferably.

Embodiment 4 of an Antenna Device

In order to receive a wide frequency range, as shown in FIG. 8, a matching circuit 22 which adjusts the resonance frequency of an antenna device is formed between a chip antenna and a feeder circuit. By changing this matching circuit 22 with a switch, the resonance frequency of an antenna device can be moved and the frequency range which operates can be changed. The resonance frequency of an antenna device can be adjusted with this matching circuit 22.

Figure 9:
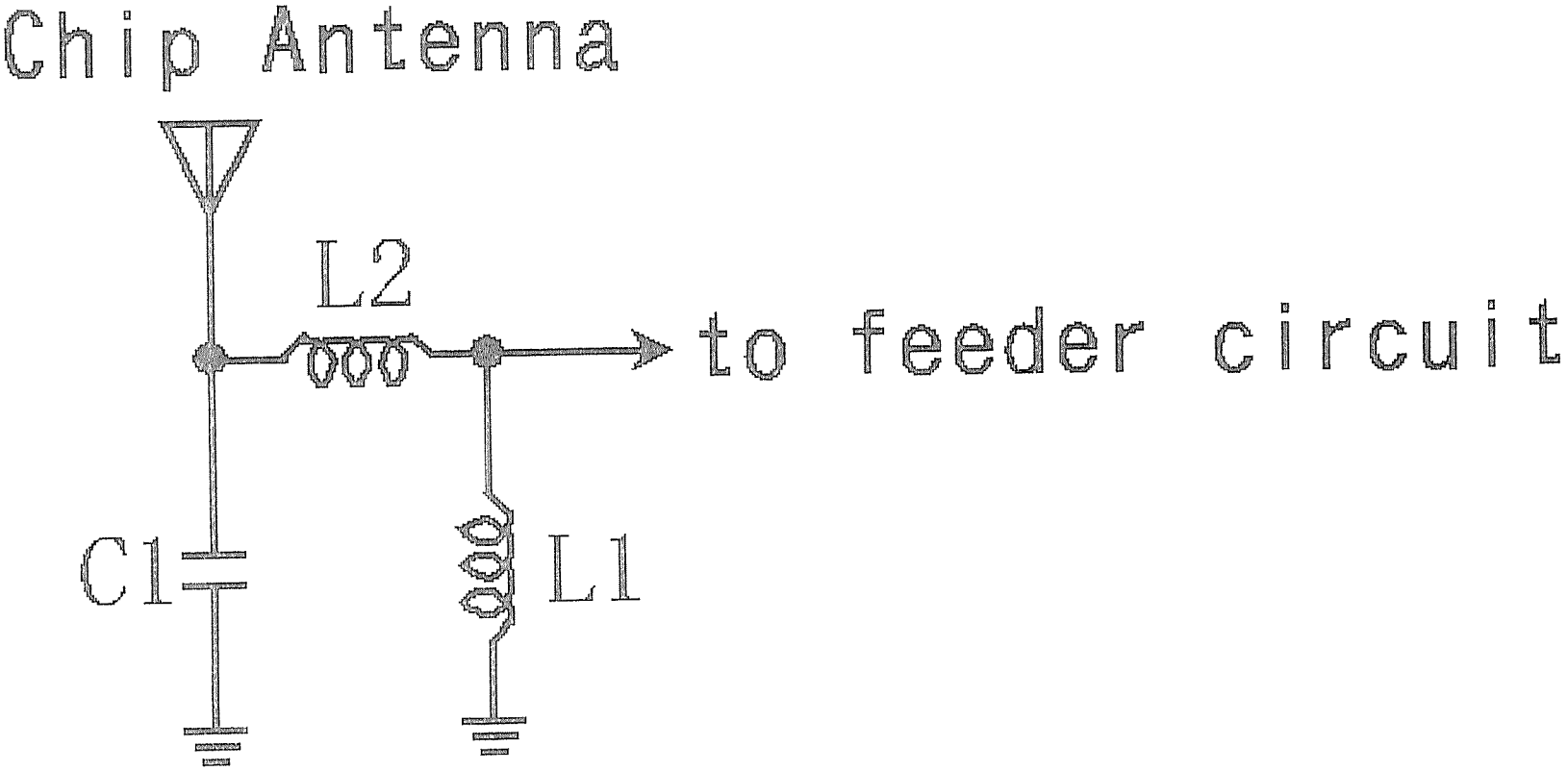
FIG. 9 shows an example of the matching circuit used for the antenna device of the invention.

The example of matching circuit 22 is shown in FIG. 9. In the example of FIG. 9, inductor L2 is connected between capacitor C1 with which one end was grounded, and the other end of inductor L1. The conductor in a chip antenna is connected to the other end of capacitor C1, and a feeder circuit is connected to the other end of inductor L2.

Several matching circuits where the inductances of inductor L2 differ are provided, and these are switched. Inductance of inductor L2 in one of the several matching circuits can be made into zero (it does not have inductor L2).

In order to switch a matching circuit, the switch and diode which use a semiconductor can be used. In this case, it is desirable in respect of the miniaturization of a circuit, integration, or low power.

Figure 22:
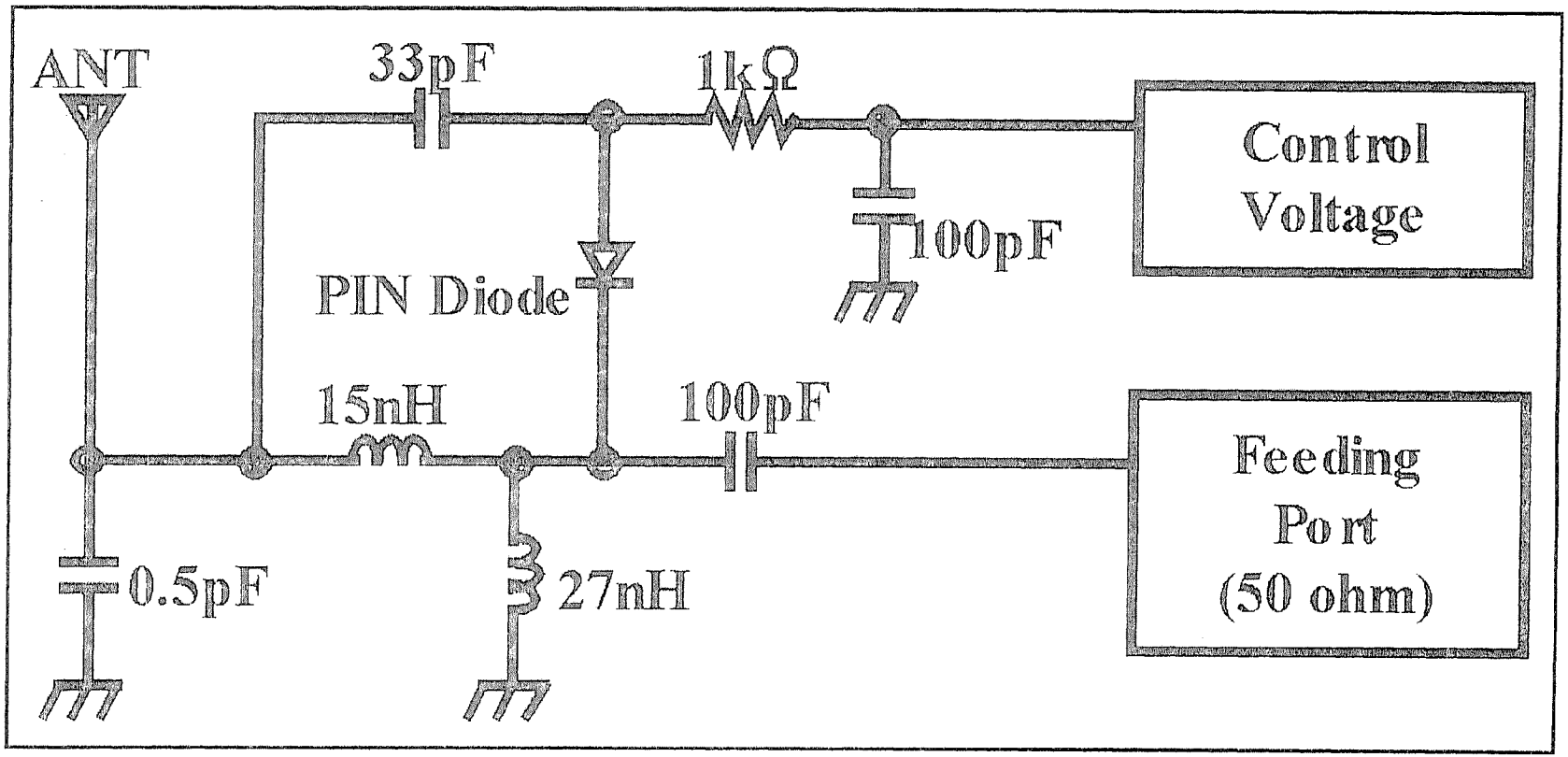
FIG. 22 shows an example of a circuit which switches a matching circuit.

The example of the circuit which switches a matching circuit is shown in FIG. 22. By adjusting control voltage, the matching circuit for high frequency bands and the matching circuit for low frequency band regions are switched. In the example in FIG. 22, when control voltage is 0V, it changes to the matching circuit for low frequency band regions. When control voltage is +1.5V, it is switched to the matching circuit for high frequency bands.

By switching two or more of these matching circuits, several states where resonance frequency differs, can be obtained with one antenna device. Only specific circuit elements, such as not only the change of the whole matching circuit but inductor L2, may be switched. If the gain more than −7 dBi is obtained by switching a matching circuit in an at least 470-770 MHz frequency range, it will become an especially suitable antenna device for ground digital broadcasting, −5 dBi or more, is more preferable.

If the number of matching circuits and the number of switches increase, so many packaging surface and the number of parts are needed. In this case, as for the number of matching circuits, since control becomes complicated, it is preferred to use two or less. It is preferred to set the number of switches to 1., To an antenna device with the bandwidth of 220 MHz, in which the complete average of an average gain is more than −7 dBi, a 470-770 MHz frequency range is receivable using one switch.

Embodiment of Communication Equipment

The antenna device constituted using the chip antenna and it is used for communication equipment. For example, the chip antenna and an antenna device can be used for communication equipment, such as a cellular phone, wireless LAN, a personal computer, and associated equipment of ground digital broadcasting, and are contributed to widen the frequency range in the communication using these apparatus.

Since the frequency range of digital terrestrial broadcasting is wide, the communication equipment using the antenna device concerning this invention is suitable for this use. Since the increase in a packaging surface and mounting space can be suppressed by using the antenna device of this invention especially, it is suitable for a cellular phone, a personal digital assistant, etc. which transmit and receive ground digital broadcasting.

Figure 10:
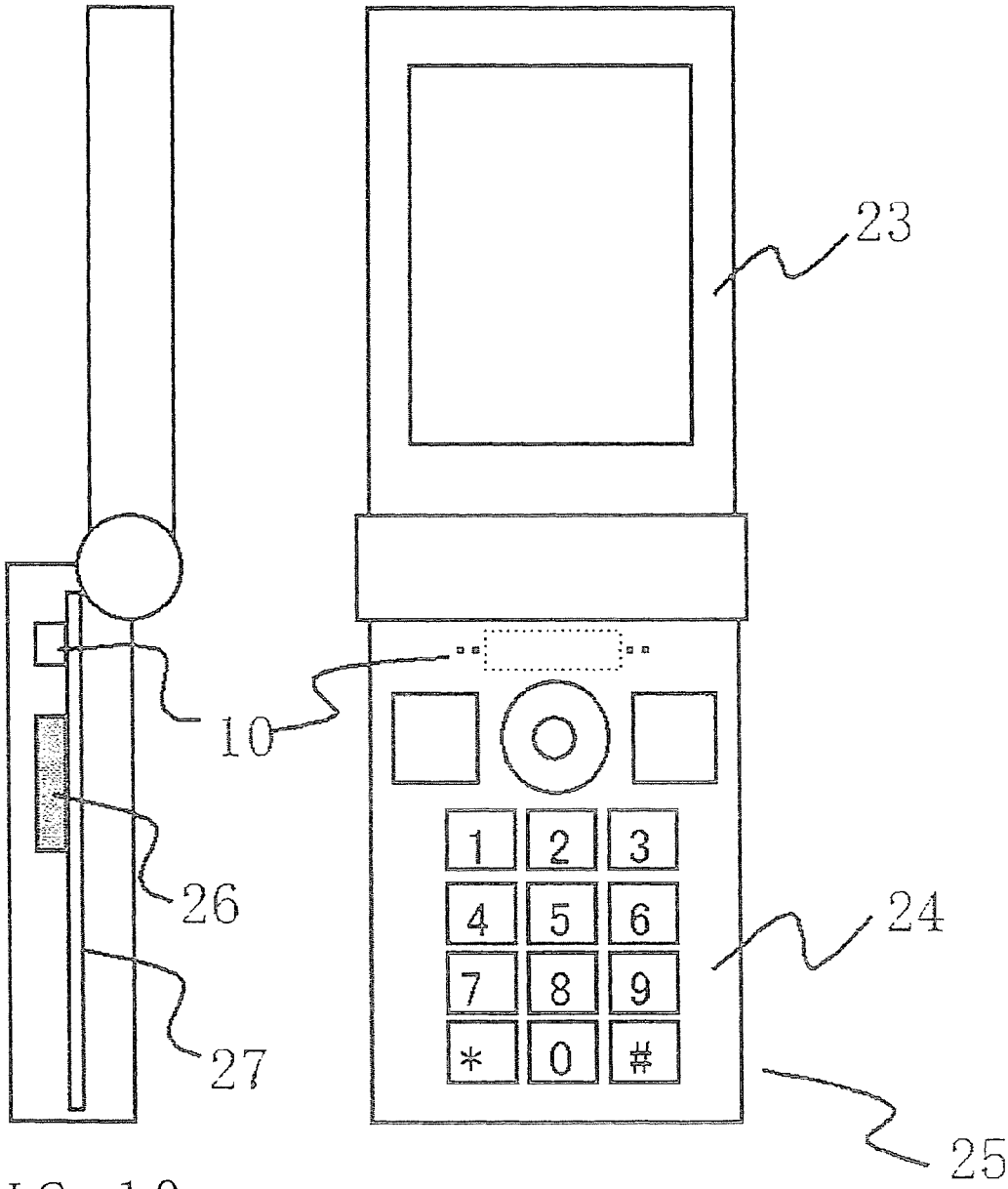
FIGS. 10(*a*)-10(*b*) show a cellular phone as an embodiment of the communication equipment of the invention.
Figures 11, 11B:
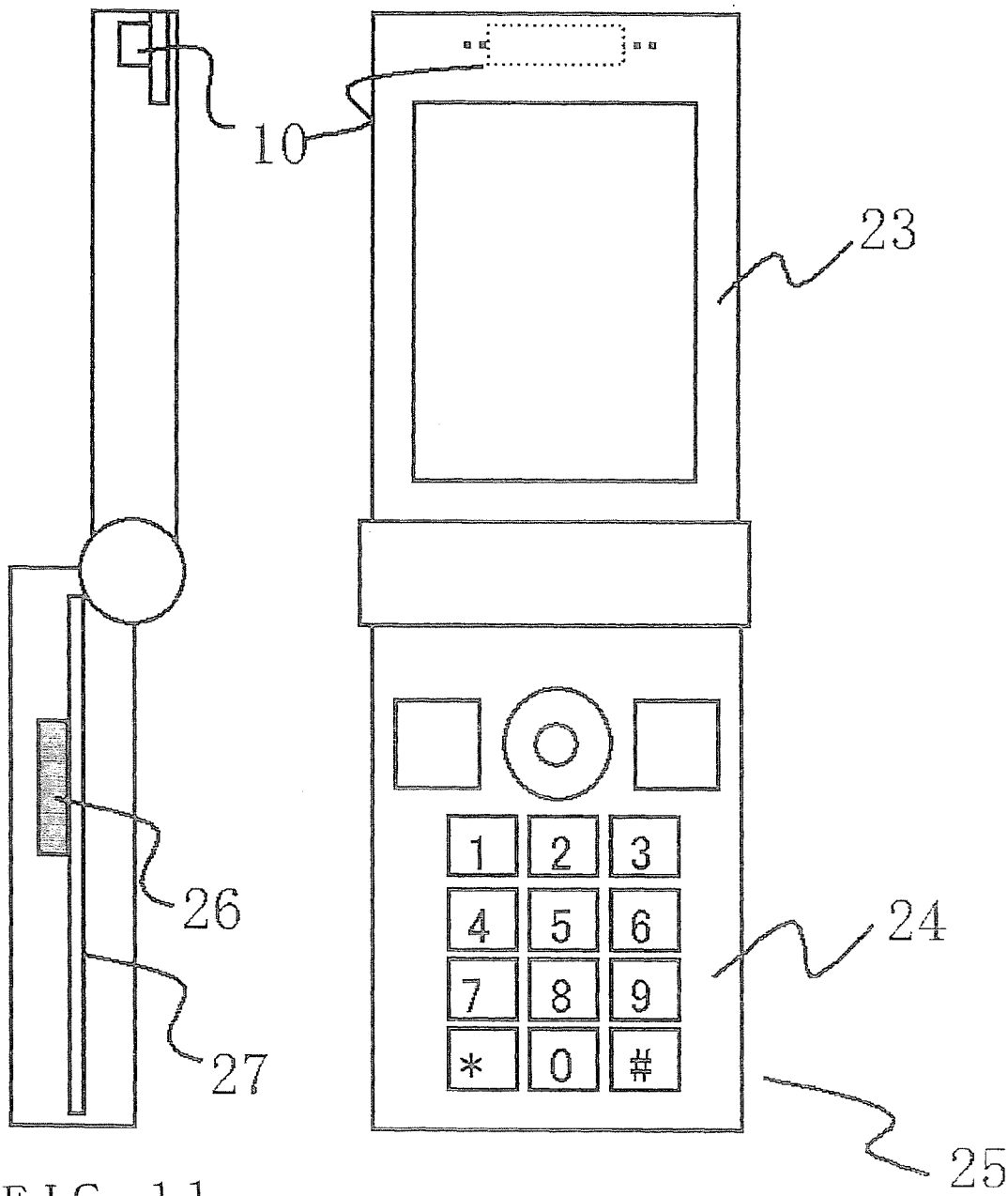
FIGS. 11(*a*)-11(*b*) show a cellular phone as another embodiment of the communication equipment of the invention.

FIG. 10 and FIG. 11 show the example which used the cellular phone as communication equipment, respectively. In FIGS. 10(*b*) and 11(*b*) showing the appearance of the cellular phone in the state where it opened, the dotted line shows the position of the built-in chip antenna. As shown in the sectional view of FIG. 10(*a*) and FIG. 11(*a*), in the cellular phone 25, a chip antenna 10 is attached to the substrate 27, and is connected to the wireless module 26.

Arrangement of the chip antenna 10 is not restricted to the form of FIG. 10 or 11. Chip antenna 10 may be arranged to the reverse end side of the operating unit 24, and may be arranged to the display unit 23.

Figure 13:
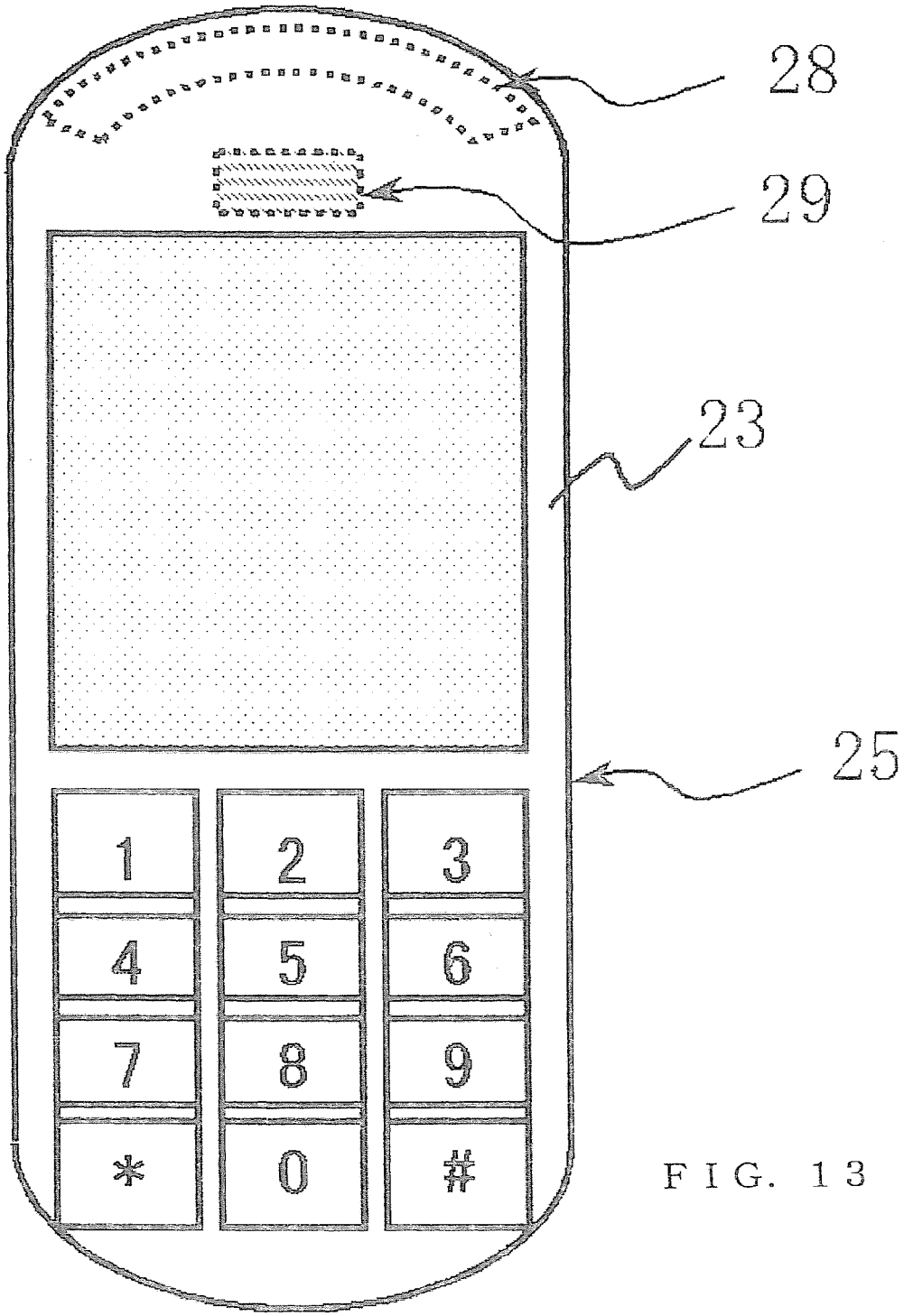
FIG. 13 shows a cellular phone as another embodiments of the communication equipment of the invention.

The example using an arch-shaped chip antenna is shown in FIG. 13. In FIG. 13, the dotted line has shown the position of chip antenna 28 built in and receiver 29. In FIG. 13, arch-shaped chip antenna 28 is arranged at the tip of display unit 23 of cellular phone 25. The curved surface of the outside of this arch shape is arranged according to the tip shape of a display unit. With this composition, a larger distance to a receiver can be taken, compared with the case where the chip antenna of rectangular parallelepiped shape is used. When the width of a cellular phone case is the same, compared with the chip antenna of rectangular parallelepiped shape, a chip antenna can be lengthened more.

EXAMPLES

Hereafter, this invention is not limited by these examples although an example explains this invention still more concretely.

Example 1

In production of the magnetic base in this example, $Fe_2O_3$, BaO($BaCO_3$ is used), and CoO ($Co_3O_4$ is used), these are the principal component, were first mixed with 60 mol %, 20 mol %, and 20 mol %, respectively. CuO or ZnO of the composition shown in Table 1 (FIG. 25) to this principal component 100 weight part was added, and it was mixed with the wet ball mill by using water for 16 hours (No 1-12). Moreover, as a material in No 13, composition of $Fe_2O_3$, BaO ($BaCO_3$ is used), and CoO ($Co_3O_4$ is used) which are principal components, was made into 70.6 mol %, 17.6 mol %, and 11.8 mol %, respectively. Similarly, it was mixed with the wet ball mill by using water as a solvent for 16 hours.

Next, about the material of No 1-12, temporary sintering was carried out at 1000 degrees C. in atmosphere in 2 hours after drying such mixed powder. About the material of No 13, temporary sintering was carried out at 1100 degrees C. in the atmosphere for 2 hours. Such temporary sintering powder was ground by the wet ball mill which used water as the solvent for 18 hours.

Binder (PVA) 1% was added to the obtained pulverized powder, and granulated. After granulation, compression molding was carried out to ring shape and rectangular parallelepiped shape.

Then, about the sample of No 1-12, sintering is carried out at 1200 degrees C. in oxygen environment for 3 hours. About the sample of No 13, sintering was carried out at 1300 degrees C. in oxygen environment for 3 hours.

The density, initial magnetic permeability μ at 25 degrees C., and loss factor tan δ, in the ring shape ceramics with the outer diameter of 7.0 mm, the inside diameter of 3.5 mm, and a height of 3.0 mm obtained by these, were measured.

The measured volume resistivity, density, and initial magnetic permeability μi and loss factor tan δ in the frequency of 1 GHz, are shown in Table 1. The measured initial magnetic permeability μi and loss factor tan δ at the frequency of 180 MHz, 470 MHz, and 770 MHz, are shown in Table 2 (FIG. 26). In addition, the density was measured by the underwater substitution method. Initial magnetic permeability μi and loss factor tan δ were measured using the impedance gain phase analyzer (HP4291B made by Yokogawa-Hewlett-Packard). About some samples, permittivity was also measured using this impedance gain phase analyzer. Here, permittivity means relative permittivity.

As a result of the X-ray diffraction, in the material of No 1-12, the phase with the largest main peak intensity was Y type ferrite, and Y type ferrite became a main phase. On the other hand, the phase by which main peak intensity of the material of No 13 is the largest was Z type ferrite, and Z phase was a main phase. It is shown in Table 1, the initial magnetic permeability of 2 or more, and loss factor of 0.05 or less at 1 GHz, were obtained in the Y type ferrite with addition of CuO 0.1-1.5 wt %, or with addition of ZnO 0.1-1.0 wt. %. Volume resistivity more than $1\times10^5\Omega\cdot$m, density more than $4.8\times10^3$ kg/m$^3$, are obtained, these are sufficient. Among these, when CuO is added especially 0.6 to 1.0%, high initial magnetic permeability of 2.7 or more, low loss factor of 0.03 or less, and high density of $4.84\times10^3$ kg/m$^3$ or more, are obtained.

On the other hand, in the material of No 13 in which Z phases are main phases, especially the loss factor is large, and density is also low.

The relative permittivity in the sample of No 4 was 14.

As shown in Table 2, when a CuO addition is 0.1-2.0 wt %, the initial magnetic permeability in a frequency range (470 MHz-770 MHz) is 2 or more, and a loss factor is 0.05 or less. This material is applicable to the chip antenna of a frequency range (470 MHz-770 MHz).

At 180 MHz, in the material in which Cu was added, or Zn was added, initial magnetic permeability of 2 or more, and the loss factor of 0.05 or less, were obtained.

Such materials are applicable to the chip antenna of a frequency range of 180 MHz or more. The ceramics of Y type ferrite have a small loss factor compared with Z type ferrite also in an about 470-770 MHz frequency range, not only at 1 GHz, and it turns out that it serves as a material of a chip antenna.

The chip antenna (antenna 1) shown in FIG. 3 using the ceramics of the material of above-mentioned No 4 was produced as follows. The magnetic members of the rectangular parallelepiped (30×3×1.5 mm and 30×3×1.75 mm) were obtained by machining ceramics, respectively. In the magnetic member which is 30×3×1.75 mm, a slot 0.5 mm in width and 0.5 mm in depth was formed along with the longitudinal direction, in the center of the cross direction of the surface which is 30×3 mm. After copper wire with the section of 0.5 mm squares and a length of 40 mm was inserted in this slot as a conductor, a 30×3×1.25 mm magnetic member pasted up with epoxy adhesive (Aremco bond 570). Adhesives were applied to the pasting side of a magnetic member.

The through-hole whose sections are 0.5 mm×0.5 mm was formed by the slot formed in the aforementioned magnetic member.

The size of the base obtained by adhesion is 30×3×3 mm. The both ends of the protruding conductor were bended outside the base, and became the conductor shape shown in FIG. 2.

In order to compare with the dielectric chip antenna, the dielectric chip antenna was produced as follows. The member of a 30×3×3 mm rectangular parallelepiped was obtained by machining the ceramics of the dielectrics whose relative permittivity is 21. The Ag—Pt paste was printed on the surface and it was baked. Thereby, the electrode that had width of 0.8 mm, and with the helical structure of the number of turns shown in Table 3 was formed. Thereby, the chip antenna (antenna 2) was produced.

The antennas 1 and 2 are mounted on the substrate on which the feed electrode was formed, respectively. The end of the electrode was connected to the feed electrode and the antenna device was constituted (set as antenna devices 1 and 2, respectively).

Antenna device 1 was set as the composition shown in FIG. 8. Here, the feed electrode and the ground electrode were formed on the printed circuit board. The fixing electrode was formed set apart from this ground electrode. The width of the fixing electrode was 4 mm and the length was 13 mm. The gap of the end of a longitudinal direction and ground electrode in this fixing electrode is 1 mm. The ground electrode was formed so that the whole chip antenna might be face oppose and the interval with that of a chip antenna was 11 mm.

The composition shown in FIG. 9 was provided as a matching circuit.

C1 was set to 1 pF, L1 was set to 12 nH, L2 was set to 18 nH. This antenna device was separated from the antenna for measurement (it installs in the right-hand side of the antenna device of FIG. 8 (not shown)) by 3 m, and was connected to the antenna gain evaluation system using a network analyzer via a 50Ω coaxial cable.

Thereby, antenna characteristics (antenna gain, resonance frequency (frequency which shows the gain maximum)) were measured. The longitudinal direction of the chip antenna in FIG. 8 was set to X. The direction right-angled in this direction was set to Y. The direction perpendicular to these, i.e., a direction perpendicular to the surface of a substrate, was set to Z. The result in the case of the vertical polarization of ZX side (H plane) is shown in Table 3.

Here, average gain bandwidth and maximum gain bandwidth are the width of the frequency range which is beyond a value predetermined in an average gain and maximum gain, respectively.

The case of the bandwidth of −7 dBi or more and the case of the bandwidth of −5 dBi or more, were shown in Table 3 (FIG. 27). As shown in Table 3, compared with antenna device 2 which is a comparative example using the dielectrics in which relative permittivity exceeds 20, bandwidth is improving sharply in antenna device 1 which is an example. In this example, Y type ferrite whose permittivity is 20 or less and also whose initial magnetic permeability at 1 GHz is 2 or more, whose loss factor is 0.05 or less, is used. Therefore, the effect of using Y type ferrite for an antenna device is confirmed. In antenna device 1, the bandwidth with an average gain of −7 dBi or more, is 260 MHz or more.

Table 3 shows the result at 470-770 MHz.

However, the field of −7 dBi or more and −5 dBi or more has also reached the field below 470 MHz, and actual bandwidth is wider than the bandwidth shown in Table 3.

Next, in the above-mentioned antenna device 1, the interval between the ground electrode which counters, and the magnetic base, was changed with 4 mm, 6 mm, 8 mm, and 11 mm, and antenna characteristics were measured. L1, L2, and C1 of the matching circuit at that time, were set to 22 nH, 27 nH, 0.5 pF (4 mm), 27 nH, 27 nH, 0.5 pF (6 mm), 27 nH, 27 nH, 0.5 pF (8 mm), 27 nH, 22 nH, and 0.5 pF (11 mm). The maximum of an average gain serves as −3.7 dBi, −1.7 dBi, −1.8 dBi, and −2.0 dBi as this interval is set to 4 mm, 6 mm, 8 mm, and 11 mm. When especially this interval was 6 mm or more, it turned out that a high average gain is obtained.

Example 2

Next, another antenna device 3 using antenna 1 was constituted, and comparative evaluation was carried out to antenna device 4 of the helical electrode structure produced using the material of same No 4. Antenna device 3 was produced with the composition shown in FIG. 8 using antenna 1. The feed electrode and the ground electrode were formed on the printed circuit board. The fixing electrode was formed set apart from this ground electrode. The width of the fixing electrode was 3.5 mm and the length was 13 mm. The gap of the end of a longitudinal direction and ground electrode in this fixing electrode is 1 mm. The ground electrode was formed so that the whole chip antenna might be countered, and the interval with that of a chip antenna was 11 mm.

Two kinds of matching circuits, the object for low frequency and the object for high frequency, were provided as a matching circuit.

These matching circuits have composition shown in FIG. 9, in the circuit for low-pass, C1, L1, and L2 were set to 1 pF, 12 nH, 18 nH, respectively, and in the circuit for high-pass, C1, L1, and L2 were set to 1 pF, 12 nH, and O nH (an inductor is not connected), respectively.

The portion corresponding to the other end of inductor L2 was connected to the antenna gain evaluation system using a network analyzer via a 50-ohm coaxial cable, and electric power was supplied. On the other hand, antenna device 4 was produced using the material of No 4.

The chip antenna was produced like the case of antenna device 2 except having made the number of turns in a helical electrode into 12 times. The arrangement on the substrate of antenna device 4 is the same as that of the case of antenna device 3.

The interval of a chip antenna and an ground electrode was 11 mm. However, a fixing electrode is not provided and has not added the matching circuit. These antenna devices 3 and 4 were separated from the antenna for measurement (it installs in the right-hand side of the antenna device of FIG. 8 (not shown)) by 3 m, and antenna characteristics (an average gain, resonance frequency) were evaluated using said antenna gain evaluation system.

The result evaluated when it was used having changed the matching circuit is shown in Table 4. The average gain band width in Table 4 is the frequency bandwidth in the case of being a case where an average gain is more than −7 dBi, and more than −5 dBi, like the case of the above-mentioned table 3. The result of a measurement of the average gain of the ZX plane (H plane) and that averaged all over three plane of the average gain of XY plane (E2 plane), YZ plane (E1 plane), and ZX plane (H plane), are shown in Table 4 (FIG. 28).

As shown in Table 4, in antenna device 4 using antenna 1, the bandwidth with −7 dBi or more, is 250 MHz or more in ZX-plane, and is 220 MHz or more in all plane average, irrespective of the matching circuit. Therefore, in the average gain in all plane average, −7 dBi or more, is obtained by switching a matching circuit in a 470-770 MHz frequency range. By the result of Table 4, in antenna device 4 which used antenna 1, the bandwidth with −5 dBi or more, is 180 MHz or more in all plane average, irrespective of the matching circuit.

Therefore, even if the desired value in the average gain in all plane average is set to −5 dBi, a 470-770 MHz frequency range is obtained by switching a matching circuit. Although the result in 470-770 MHz is shown in Table 4, the field of −7 dBi or more has also reached the field below 470 MHz, or the field of more than 770 MHz, and actual bandwidth is wider than the bandwidth shown in Table 4. For example, in antenna device 3, the average gain in all plane average using the matching circuit for high-pass, is −2.0 dBi also in 770 MHz. The average gain in all plane average using the matching circuit for low-pass, is −3.4 dBi in 470 MHz, which is very high. Therefore, it is also possible by controlling resonance frequency by adjustment of a matching circuit to fill a 470-770 MHz frequency range with one chip antenna without the change of a matching circuit.

Example 3

Next, the antenna device 5 is produced with the composition shown in FIG. 8 using antenna 1. The feed electrode and the ground electrode were formed on the printed circuit board. The fixing electrode was formed set apart from this ground electrode. The width of the fixing electrode was 3.5 mm and the length was 13 mm. The gap of the end of a longitudinal direction and ground electrode in this fixing electrode is 1 mm.

However, the ground electrode was formed in the portion which does not counter the whole chip antenna but counters a fixing electrode. Two kinds of matching circuits, for low-pass and for high-pass, were provided. The matching circuit shown in FIG. 9 is used. For low-pass, C1, L1, and L2 were set to 0.5 pF, 15 nH, and 15 nH respectively. And for high-pass, C1 is set to 0.5 pF. Instead of L1, C2 is set and was set to 2 pF, L2 is set to 0 nH (an inductor is not connected).

This antenna device was mounted in the cellular phone. The mounting place was used as the tip of the display unit of a cellular phone as shown in schematic diagram 11. The chip antenna has been arranged so that it may become parallel at the tip of a display unit, and so that the interval from the receiver which consists of loudspeakers etc. may be set to 12 mm.

The portion which corresponds to the other end of inductor L2 for evaluation of antenna characteristics, was connected to the antenna gain evaluation system using a network analyzer via a 50-ohm coaxial cable. Thereby, electric supply was performed.

The result evaluated when it was used having changed the matching circuit is shown in Table 5 (FIG. 29). The evaluation result of the average gain averaged in all plane is shown in Table 5.

Also in the state where it mounted in the cellular phone, the bandwidth of 220 MHz or more was obtained, irrespective of the matching circuit. In a 470-770 MHz band, the average gain of −7 dBi was obtained by switching a matching circuit. Although the evaluation result in 470-770 MHz is shown in Table 5, the field of −7 dBi or more by the side of low-pass has also reached the field below 470 MHz. A band of 770 MHz or more is reached similarly. The field of −5 dBi or more has also reached the field below 470 MHz. Therefore, actual bandwidth is wider than the bandwidth shown in Table 5.

Therefore, in the frequency range over 470-770 MHz, the average gain of −5 dBi or more can also be obtained by tuning the matching circuit for low-pass, and the matching circuit for high regions finely.

When the interval of a receiver and a chip antenna was changed, the gain improved and by enlarging this interval showed the tendency for bandwidth to spread.

When this interval was less than 4 mm, the fall of bandwidth became large, and it turned out that 4 mm or more is preferred.

Example 4

$Fe_2O_3$, BaO ($BaCO_3$ is used), and CoO ($Co_3O_4$ is used), as main components, were mixed like the material of No 4 of Table 1, with 60 mol %, 20 mol %, and 20 mol %, respectively. To 100% of the weight of this principal component, the CuO 0.6 weight % was added and it was mixed with the wet ball mill by using water as a solvent. Next, after drying this mixed powder, temporary sintering was carried out at 1100 degrees C. in the atmosphere for 1.5 hours. This temporary sintering powder was ground by the wet ball mill which used water as the solvent for 10 hours. Water, the binder, the lubricant, and the plasticizer were added to the obtained pulverized powder, and extrusion molding was performed. After drying the acquired forming object, it was sintered at 1150 degrees C. in the air for 3 hours. Thereby, the ceramics of 30 mm×3 mm×3 mm rectangular parallelepiped form were obtained.

The through-hole with a circular section about 0.6 mm in diameter was formed in the center of these ceramics along with the longitudinal direction. The radius of curvature with a beveling width of 0.5 mm was formed in the portion of four corners located in the direction perpendicular to this longitudinal direction. When the deviation from cylindrical form (difference of an maximum diameter and a minimum diameter) of the through-hole was measured about two or more ceramics, the deviation was also 10 micrometers or less. When the conditions of extrusion molding were changed and deviation from cylindrical form produced what is 48-149 micrometers, it was difficult to insert a conductor. In this case, there were many through-holes which are long along one direction, and short along another direction perpendicular to the direction, in a square shaped cross section.

The obtained ceramics were used as a magnetic base, the copper wire with 0.6 mm in diameter was inserted and penetrated, and the chip antenna was constituted. The difference of the maximum diameter in a through-hole and the diameter of the copper wire was 22-45 micrometers. Antenna device 6 was produced with the composition shown in FIG. 8 using this chip antenna.

The feed electrode and the ground electrode were formed on the 40-mm-wide printed circuit board. And the fixing electrode was formed set apart from this ground electrode. The ground electrode was formed on both sides of the printed circuit board, in the field set apart from the tip side which mounts a chip antenna by 15 mm or more. The width of fixing electrode 5 was set to 3.5 mm. And the width of feed electrode 6 was set to set 1 mm and the length was set to 13 mm. The gap of the end of a longitudinal direction and ground electrode in this fixing electrode is 1 mm.

The reason for having made width of fixing electrode 5 wider than the width of fixing electrode 6 is for enlarging electrostatic capacity between the end of fixing electrode 5 and an ground electrode.

Thereby, antenna resonant frequency can be made low and it can miniaturize. Forming the ground electrode so that the whole chip antenna might be countered, the interval with a chip antenna was set to 11 mm. Two kinds of matching circuits, for low-pass and for high-pass, were provided. A matching circuit has the composition shown in FIG. 15. C1, L2, and L3 were set to 0.5 pF, 68 nH, 18 nH, respectively.

Antenna characteristics were evaluated like Example 2.

Figure 23:
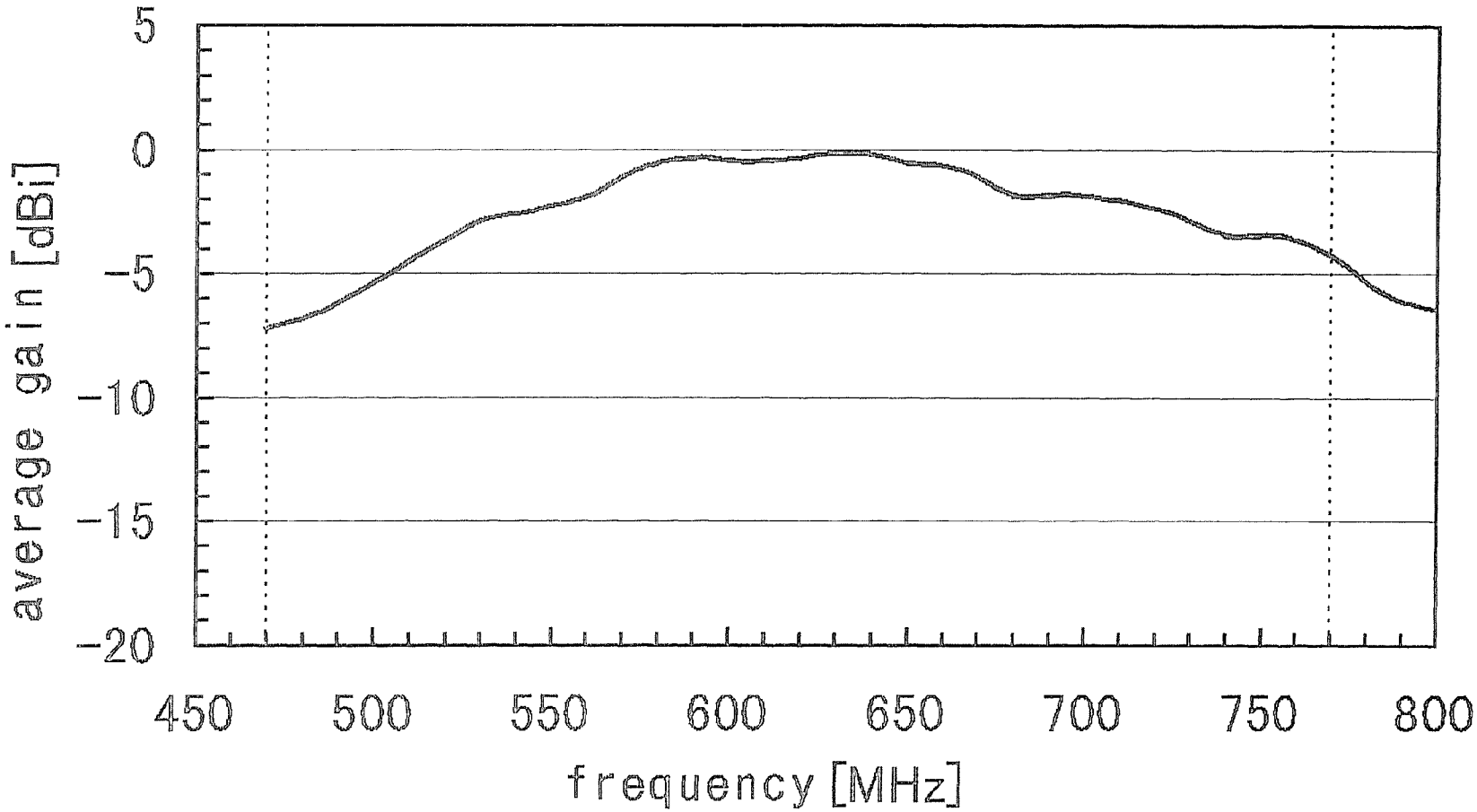
FIG. 23 shows the antenna characteristics in the antenna device concerning the invention.

The evaluation result of the average gain averaged in all plane is shown in FIG. 23. The bandwidth with average gain of −7 dB or more, is 330 MHz (475-800 MHz). The bandwidth with average gain of −5 dB or more, is 275 MHz (503-778 MHz). Therefore, the antenna device with wide bandwidth was obtained.

By adjusting a matching circuit etc. with one antenna device, this result shows that it is possible to receive a 470-770 MHz band, without switching the matching circuit.

Next, the ceramics produced by extrusion molding were processed and the 3-point bending strength was measured. The ceramics of the material of No 4 produced in the Example 1 were processed similarly, and bending strength was also measured. The bending strength was calculated as the average of ten test pieces. The bending strength of the ceramics produced in the Example 1 was 200 MPa. The bending strength of the ceramics produced by extrusion molding is 217 MPa, and the strength was improved by about 10%. Therefore, improvement in the mechanical strength of a chip antenna can be aimed at by using the magnetic base obtained with the application of extrusion molding. The magnetic base with bending strength of 210 MPa or more, is advantageous for the portable device to which a strong impact is added.

Also in the ceramics produced in the Example 1, also in the ceramics produced by extrusion molding, the carbon content in ceramics was 0.01 mass %. The section of the ceramics produced by said extrusion molding and the ceramics of the material of No 4 produced in the Example 1 was observed by SEM. There were many pore with large diameter in the former, and there was much micropore in the latter. And the number of pore with diameter larger than 1 μm in 1 $mm^2$, was 1800, and 9000 respectively.

These ceramics were etched after mirror polishing. Then, the section was observed with the optical microscope. The average crystal grain diameter of ceramics was computed by having counted particle number N which exists along the line equivalent to 200 micrometers, and having done division of the 200 micrometers by N. As a result, the average crystal grain diameter in the ceramics produced by extrusion molding was 2.5 micrometers. On the other hand, the average crystal grain diameter in the ceramics of the material of No 4 produced in the Example 1 was 2.0 micrometers. Therefore, it is possible to obtain the chip antenna which is excellent in mechanical strength as mentioned above, by setting the average crystal grain diameter to 2.8 micrometers or less, and setting the number of pore with diameter of 1 micrometers or more in 1 $mm^2$ to 2% or more.

What is claimed is:

1. An antenna device, comprising:

a magnetic base; and a linear conductor penetrating said magnetic base along a longitudinal direction of said magnetic base;

wherein said linear conductor penetrates said magnetic base inside straightly, wherein a ratio s/S of a cross-sectional area s of said conductor to a cross-sectional area S of said magnetic base in a section perpendicular to said longitudinal direction of said magnetic base is 0.029 or more, and wherein a protruding portion of said linear conductor is connected electrically to an electrode or a conductor formed in a case, apart from a surface of said magnetic base.

2. The chip antenna device according to claim 1, wherein said ratio s/S is 0.125 or less.

3. The antenna device according to claim 2, wherein no electrode is formed on surfaces of said magnetic base.

4. The antenna device according to claim 1, wherein said magnetic base is composed of a sintered body of Y type ferrite.

5. The antenna device according to claim 4, wherein a density of said sintered body is higher than $4.8\times10^3$ kg/m$^3$.

6. The antenna device according to claim 5, wherein no electrode is formed on surfaces of said magnetic base.

7. The antenna device according to claim 4, wherein initial permeability at 1 GHz of said Y type ferrite is set to 2 or higher, and a loss factor is set to 0.05 or lower.

8. The antenna device according to claim 7, wherein no electrode is formed on surfaces of said magnetic base.

9. The antenna device according to claim 4, wherein said Y type ferrite is made from BaO: 20-23 mol %, CoO: 17-21 mol %, and $Fe_2O_3$, Cu and Zn are also contained, with a Cu content of 0.1 to 1.5% by weight by CuO conversion, a Zn content of 0.1 to 1.0% by weight by ZnO conversion.

10. The antenna device according to claim 9, wherein no electrode is formed on surfaces of said magnetic base.

11. The antenna device according to claim 1, wherein relative permittivity of said magnetic base is 8 or more.

12. The antenna device according to claim 11, wherein no electrode is formed on surfaces of said magnetic base.

13. The antenna device according to claim 1, wherein no electrode is formed on surfaces of said magnetic base.

14. The antenna device according to claim 4, wherein no electrode is formed on surfaces of said magnetic base.

* * * * *